US011761057B1

(12) United States Patent
Stowell et al.

(10) Patent No.: US 11,761,057 B1
(45) Date of Patent: Sep. 19, 2023

(54) METHOD FOR REFINING ONE OR MORE CRITICAL MINERALS

(71) Applicant: Lyten, Inc., San Jose, CA (US)

(72) Inventors: Michael Stowell, Sunnyvale, CA (US); Bruce Gittleman, Centennial, CO (US)

(73) Assignee: Lyten, Inc., San Jose, CA (US)

( * ) Notice: Subject to any disclaimer, the term of this patent is extended or adjusted under 35 U.S.C. 154(b) by 0 days.

(21) Appl. No.: 18/110,834

(22) Filed: Feb. 16, 2023

Related U.S. Application Data

(60) Provisional application No. 63/329,208, filed on Apr. 8, 2022, provisional application No. 63/324,379, filed on Mar. 28, 2022.

(51) Int. Cl.
*C22B 26/12* (2006.01)

(52) U.S. Cl.
CPC ..... *C22B 26/12* (2013.01)

(58) Field of Classification Search
CPC ..... C22B 26/12
USPC ..... 423/179.5
See application file for complete search history.

(56) References Cited

U.S. PATENT DOCUMENTS

| | | | |
|---|---|---|---|
| 4,002,492 | A | 1/1977 | Rao |
| 4,330,601 | A | 5/1982 | Dey |
| 4,738,716 | A | 4/1988 | Roumieu |
| 5,278,005 | A | 1/1994 | Yamauchi et al. |
| 5,282,880 | A | 2/1994 | Olson |
| 6,971,276 | B2 | 12/2005 | Harris et al. |
| 8,834,958 | B2 | 9/2014 | Zhang |
| 2008/0318128 | A1 | 12/2008 | Simoneau et al. |
| 2009/0200025 | A1 | 8/2009 | Bravo |
| 2011/0275195 | A1 | 11/2011 | Meade |
| 2014/0219904 | A1 | 8/2014 | McAlister |
| 2014/0248540 | A1 | 9/2014 | Zhang |
| 2017/0043315 | A1 | 2/2017 | Lansell et al. |
| 2020/0263285 | A1 | 8/2020 | Stowell et al. |
| 2020/0402768 | A1 | 12/2020 | Stowell et al. |
| 2022/0021019 | A1 | 1/2022 | Tan et al. |

FOREIGN PATENT DOCUMENTS

| | | | | |
|---|---|---|---|---|
| CN | 100432248 | C | 11/2008 | |
| CN | 110190251 | A | 8/2019 | |
| CN | 111097920 | A * | 5/2020 | ..... B01D 5/0036 |
| CN | 113088705 | A * | 7/2021 | ..... C01G 51/10 |
| WO | 2022129736 | A1 | 6/2022 | |
| WO | 2022200694 | A1 | 9/2022 | |

OTHER PUBLICATIONS

Wikipedia, "Calcium oxide," Wikidpedia, 2023, 6 pages, retrieved from https://en.wikipedia.org/wiki/Calcium_oxide.
Flexbooks, "1.5 Decomposition Reactions," FlexBooks, Oct. 2022, 5 pages, retrieved from https://flexbooks.ck12.org/cbook/cbse-chemistry-class-10/section/1.5/primary/lesson/decomposition-reactions/.
Fraissler et al., "Influence of dry and humid gaseous atmosphere on the thermal decomposition of calcium chloride and its impact on the remove of heavy metals by chlorination," Chemical Engineering and Processing: Process Intensification, vol. 4, Jan. 2009, pp. 380-388, Abstract Only.
Mayfair, A., "How to Mix Calcium Chloride and Water," Sciencing, Mar. 13, 2018, 6 pages, retrieved from https://sciencing.com/baking-powder-science-projects-7961560.html.
Otake et al., "Involvement of Solid Acids in the Thermal Decomposition of Calcium Chloride," The Society of Chemical Engineers Japan, vol. 09, 1983, pp. 523-529, Abstract Only.
Wikipedia, "Calcium chloride," Wikidpedia, 2023, 10 pages, retrieved from https://en.wikipedia.org/wiki/Calcium_chloride.
R/CHEMISTRY, "Question(s) regarding decomposition of calcium chloride," r/chemistry, 2023, 11 pages, retrieved from https://www.reddit.com/r/chemistry/comments/6vdrxi/questions_regarding_decomposition_of_calcium/.
Cheng et el., "Influence of calcium chloride impregnation on the thermal and high-temperature carbonization properties of bamboo fiber," PLOS One, vol. 14, Feb. 28, 2019, pp. 1-12.
Watanabe et al., "The Synthesis and Thermal Decomposition of Calcium Phosphoramidate," Bulletin of the Chemical Society of Japan, vol. 57, No. 10, 1984, pp. 2914-2918.
OXY, "Everything Calcium Chloride," OXY Occidental Chemical Corporation, 2023, 2 pages, retrieved from https://www.oxycalciumchloride.com/about-us/everything-calcium-chloride.
Beyer et al., "Thermal and electrochemical decomposition of lithium peroxide in non-catalyzed carbon cathodes for Li-air batteries," Physical Chemistry Chemical Physics, 2013, 5 pages, Abstract Only.
Stowell et al., U.S. Appl. No. 18/115,604, filed Feb. 28, 2023.
Zhang et al., "A tin-plated copper substrate for efficient cycling of lithium metal in an anode-free rechargeable lithium battery," Electrochimica Acta, vol. 258, 2017, pp. 1201-1207.
(Continued)

*Primary Examiner* — Edward M Johnson
(74) *Attorney, Agent, or Firm* — Zilka-Kotab, P.C.

(57) ABSTRACT

The invention enables "green" and "conflict-free" acquisition of critical minerals via refinement from aqueous sources. These advantages are impactful in applications including refinement of rare materials such as certain metals, especially metals necessary for production of energy storage devices required to advance environmental goals, such as in the Paris climate agreement. The inventive concepts include economically viable approaches to refinement, as well as economically viable apparatuses. In some approaches, valuable materials such as metals are refined from salts obtained from aqueous sources. Power required to refine materials is provided by renewable energy sources. Real world implementations involve co-locating a dissociative reactor with a geothermal energy plant near an aquifer with salt(s) therein. Refined minerals are produced on site. Practice of the disclosed techniques reduce or eliminate many negative environmental impacts such as those incurred by legacy mining based techniques.

20 Claims, 10 Drawing Sheets

(56) References Cited

OTHER PUBLICATIONS

Wang et al., "Stabilization of Sn Anode through Structural Reconstruction of a Cu—Sn Intermetallic Coating Layer," Advanced Materials, vol. 32, 2020, pp. 1-9.
Besenhard et al., "Will advanced lithium-alloy anodes have a chance in lithium-ion batteries?" Journal of Power Sources, vol. 68, 1997, pp. 87-90.
Yuan et al., "An ultrastable lithium metal anode enabled by designed metal fluoride spansules," Science Advances, vol. 10, Mar. 6, 2020, pp. 1-9.
Li et al., "Circumventing huge volume strain in alloy anodes of lithium batteries," Nature Communications, vol. 11, Apr. 2020, pp. 1-8.
Kong et al., "Lithium-Magnesium Alloy as a Stable Anode for Lithium-Sulfur Battery," Advanced Functional Materials, vol. 29, No. 13, Feb. 9, 2019, 2 pages, Abstract Only.
Yang et al., "A review for modified Li composite anode: Principle, preparation and challenge," Nanotechnology Reviews, vol. 9, 2020, pp. 1610-1624.
Pathak et al., "Recent Advances in Lithiophilic Porous Framework toward Dendrite-Free Lithium Metal Anode," Applied Sciences, vol. 10, 2020, pp. 1-21.
Rogers et al., "Effect of Pressure on the Refining of Lithium by Distillation," Journal of the Electrochemical Society, vol. 98, No. 12, Dec. 1951, pp. 483-487.
Sertoglu, K., "6K launches new $25M battery material production facility," 3D Printing Industry, Apr. 29, 2021, 7 pages, retrieved from https://3dprintingindustry.com/news/6k-launches-new-25m-battery-material-production-facility-189297/.
Sertoglu, K., "6K and Albemarle partner to develop sustainable lithium battery materials," 3D Printing Industry, Jan. 14, 2022, 7 pages, retrieved from https://3dprintingindustry.com/news/6k-and-albemarle-partner-to-develop-sustainable-lithium-battery-materials-202348/.
Park et al., "Electrolytic Reduction of Lithium Chloride from Mixtures with Alkali and Alkali Earth Metal Salts," Workshop on Spent Fuel Management Technology, Nov. 1997, pp. 26-34.
Clark, R.J., "A Convenient Method of Distillation of the Alkali Metals," Mathematical Proceedings of the Cambridge Philosophical Society , vol. 23, No. 8, Oct. 1927 , pp. 953-955, Abstract Only.
Horsley, G. W., "A filtration and vacuum distillation unit for the purification of alkali metals," Journal of Applied Chemistry, vol. 6, No. 1, Jan. 1958, pp. 13-18, Abstract Only.
Horsley, G. W., "A filtration and vacuum distillation unit for the purification of alkali metals," Journal of Applied Chemistry, vol. 8, No. 1, May 2007, pp. 13-18, Abstract Only.
Peterson, D., "Purification of Alkaline Earth Metals," The Journal of The Minerals, Metals & Materials Society (TMS), vol. 39, 1987, pp. 20-23, Abstract Only.
Boudreau, K., "Group 1A—The Alkali Metals," Periodic table, Angelo State University, Department of Chemistry, retrieved from https://www.angelo.edu/faculty/kboudrea/periodic/periodic_main1.htm#:~:text=The%20valence%20electron%20is%20easily,39%C2%BAC%2C%20and%20cesium%20at%2028%C2%BAC on Feb. 12, 2022, 10 pages.
Gahn, R., "Vacuum distillation technique for recovery alkali-metal reaction products," Analytical Chemistry, vol. 40, May 1, 1968, pp. 996-998, Abstract Only.
Solar Impulse Foundation, "APT-HP High-power plasma torch," Solar Impulse Foundation, Dec. 2020, 6 pages, retrieved from https://solarimpulse.com/solutions-explorer/apt-hp-high-power-plasma-torch.
Wikipedia, "Downs cell," Wikidpedia, 2022, 2 pages, retrieved from https://en.wikipedia.org/wiki/Downs_cell.
chemiday.com, "The thermal decomposition of lithium carbonate," chemiday.com, 2022, 2 pages, retrieved from https://chemiday.com/en/reaction/3-1-0-7048.
CSIRO, "LithSonic lithium metal production," CSIRO, 2022, 6 pages, retrieved from https://www.csiro.au/en/work-with-us/ip-commercialisation/marketplace/lithsonic-lithium-metal-production.
Google Search "Plasma Torch," Google search, 2022, 2 pages, retrieved from https://www.google.com/imgres?imgurl=https%3A%2F%2Fforum.langmuirsystems.com%2Fuploads%2Fdefault%2Foriginal%2F2X%2Fc%2Fce1335c.
Jema, "Plasma Torch," Jema, 2022, 6 pages, retrieved from https://www.jema-power.com/technology/plasma/.
NASA's Jet Propulsion Laboratory, "Spill-Resistant Alkali-Metal-Vapor Dispenser," Tech Briefs, Physical Sciences, Nov. 1, 2005, 6 pages, retrieved from https://www.techbriefs.com/component/content/article/tb/pub/briefs/physical-sciences/537.
Quora, "What are some of the products of the electrolysis of lithium chloride?" Quora, 2022, 7 pages, retrieved from https://www.quora.com/What-are-some-of-the-products-of-the-electrolysis-of-lithium-chloride.
Wikipedia, "Alkali metal," Wikipedia, 2023, 45 pages, retrieved from https://en.wikipedia.org/wiki/Alkali_metal.
Science Direct, "Alkali Metal—An Overview," Science Direct Topics, 2023, 7 pages, retrieved from https://www.sciencedirect.com/topics/engineering/alkali-metal.
Nefedov et al., "Problem of the lithium peroxide thermal stability," IOP Conference Series: Materials Science and Engineering, vol. 112, 2016, pp. 1-6.
Wikipedia, "Lithium oxide," Wikipedia, 2023, 4 pages, retrieved from https://en.wikipedia.org/wiki/Lithium_oxide.
Takahashi et al., "Preparation and characterization of lithium oxide," Fusion Engineering and Design, vol. 8, 1989, pp. 399-405, Abstract Only.
Ktalkherman et al., "Production of lithium oxide by decompostion lithium carbonate in the flow of a heat carrier," Theoretical Foundations of Chemical Engineering, vol. 43, 2009, pp. 88-93, Abstract Only.
Kim et al., "Thermal Decomposition Study on Li2O2 for Li2NiO2 Synthesis as a Sacrificing Positive Additive of Lithium-Ion Batteries," Molecules, vol. 24, 2019, pp. 1-8.
Nagwa, "Question Video: Calculating the the Enthalpy Change for the Thermal Decomposition of Lithium Carbonate Using Enthalpies of Formation," Nagwa, 2023, 4 pages, retrieved from NAGWA, Question Video_ Calculating the the Enthalpy Change for the Thermal Decomposition of Lithium Carbonate Using Enthalpies of Formation _ Nagwa.
Quora, "What is the reaction of decomposition of lithium nitrate?" Quora, 2023, 6 pages, retrieved from https://www.quora.com/What-is-the-reaction-of-decomposition-of-lithium-nitrate.
Shi et al., "Process of Thermal Decomposition of Lithium Carbonate," Springer Professional, 2020, 3 pages, Abstract Only.
Ortman et al., "Preparation, Characterization, and Melting Point of High-Purity Lithium Oxide," Journal of the American Ceramic Society, Sep. 1983, pp. 645-648, Abstract Only.
Science Learning Hub, "Carbonate chemistry," Science Learning Hub, 2023, 7 pages, retrieved from https://www.sciencelearn.org.nz/resources/469-carbonate-chemistry#:~:text=When%20heated%20above%20840%C2%B0,calcium%20oxide%20%E2%80%93%20a%20white%20solid.&text=The%20thermal%20decomposition%20of%20calcium,the%20oldest%20chemical%20reactions%20known.
Karunadasa et al., "Thermal decomposition of calcium carbonate (calcite polymorph) as examined by in-situ high-temperature X-ray powder diffraction," Journal of Physics and Chemistry of Solids, vol. 134, Nov. 2019, pp. 21-28, Abstract Only.
Royal Society of Chemistry, "Thermal decomposition of calcium carbonate," RSC Education, 2023, 5 pages, retrieved from https://edu.rsc.org/experiments/thermal-decomposition-of-calcium-carbonate/704.article.
BYJU'S, "What is the reaction of the decomposition of Calcium carbonate?" BYJU'S, 2023, 5 pages, retrieved from https://byjus.com/question-answer/what-is-the-reaction-of-the-decomposition-of-calcium-carbonate/.
Online Math Learning, "Thermal Decomposition of Calcium Carbonate," OnlineMathLearning.com, 2022, 12 pages, retrieved from https://www.onlinemathlearning.com/calcium-carbonate.html.

(56) References Cited

OTHER PUBLICATIONS

Socratic, "What is the reaction of the decomposition of calcium carbonate?" Socratic Q&A, 2014, 2 pages, retrieved from https://socratic.org/questions/what-is-the-reaction-of-the-decomposition-of-calcium-carbonate.
Galan et al., "Calcium carbonate decomposition," Journal of Thermal Analysis and Calorimetry volume, vol. 111, 2013, pp. 1197-1202, Abstract Only.
Bitesize, "Thermal decomposition," BBC, Bitesize, 2023, 10 pages, retrieved from https://www.bbc.co.uk/bitesize/topics/zypsgk7/articles/zrgysk7.
Bilton et al., "Investigating the optimum conditions for the formation of calcium oxide, used for CO2 sequestration, by thermal decomposition of calcium acetate," Journal of Physics: Conference Series, Electron Microscopy and Analysis Group Conference, 2011, pp. 1-4.
Socratic, "What is the chemical equation for the decomposition of calcium oxide?" Socratic Q&A, 2016, 2 pages, retrieved from https://socratic.org/questions/what-is-the-chemical-equation-for-the-decomposition-of-calcium-oxide.
Stack Exchange, "Why doesn't CaO decompose into Ca and O2?" Stack Exchange, Chemistry, 2023, 3 pages, retrieved from https://chemistry.stackexchange.com/questions/42719/why-doesnt-cao-decompose-into-ca-and-o2.
Mikhail et al., "Kinetics of the thermal decomposition of calcium hydroxide," Journal of Colloid and Interface Science, vol. 21, No. 4, Apr. 1966, pp. 394-404, Abstract Only.
International Search Report and Written Opinion from PCT Application No. PCT/US23/13355, dated Jun. 7, 2023.

* cited by examiner

METHOD FOR REFINING ONE OR MORE CRITICAL MINERALS

RELATED APPLICATIONS

This Patent application claims priority to U.S. Provisional Patent Application No. 63/324,379, filed Mar. 28, 2022 and entitled "METAL REFINEMENT IN A TEMPERATURE-CONTROLLED MATERIAL PROCESSING REACTOR", and U.S. Provisional Patent Application No. 63/329,208, filed Apr. 8, 2022 and entitled "TEMPERATURE CONTROLLED MATERIAL PROCESSING REACTOR", the contents of each of which are herein incorporated by reference in entirety.

This Patent Application is also related to U.S. patent application Ser. No. 15/351,858, filed on Nov. 15, 2016 and entitled "Microwave Chemical Processing", as well as U.S. application Ser. No. 16/751,086, filed on Jan. 23, 2020 and entitled "Complex Modality Reactor for Materials Production and Synthesis", the contents of each of which are herein incorporated by reference in entirety.

The disclosures of all prior and related Applications are considered part of and are incorporated by reference in this Patent Application.

TECHNICAL FIELD

This disclosure generally relates to production of critical minerals such as elemental lithium a dissociating reactor that is co-located near a renewable energy source and renewable energy production facility, such as an aqueous source of geothermal energy and optionally near a geothermal electric energy production facility.

BACKGROUND

Conventionally, obtaining rare minerals (principally including, but not limited to, metals, especially rare metals such as lithium, sodium, etc., especially ionic conductors) involves extensive heavy equipment that is associated with legacy surface and subsurface mining operations. In addition to use of extremely energy intensive heavy equipment, the associated refinement infrastructure is exceptionally energy intensive and inefficient. For example, the aforementioned heavy equipment involves diesel-powered internal-combustion engines and the aforementioned refinement infrastructure involves industrial-sized kilns or furnaces. Surface and subsurface mining techniques also involve energy intensive and environmentally harmful processes such as high temperature fracturing of raw materials, massive roasting operations, beneficiation, and the like. These procedures are accompanied by undesirable consequences including but not limited to toxic leaching and high temperature leaching, further exacerbating the negative impact.

These legacy mining processes are (1) wastefully energy intensive; and (2) egregiously polluting to the environment. In the specific case of mining lithium, these legacy surface mining-based and subsurface mining-based techniques profligate expenditures of energy fly in the face of the end purpose of obtaining raw materials required for many "green" applications. For example, elemental lithium is a critical material for production of high-efficiency energy storage devices that are necessary for "green" applications including but not limited to electric vehicle production and operation.

Moreover, surface and subsurface mining-based techniques for obtaining valuable materials are locked-up by sovereign entities who control the various territories where there are substantial deposits of the critical minerals. In many cases, these sovereign entities are embroiled in political turmoil, thus casting doubt on the reliability of supply chains that rely on access to the aforementioned deposits.

Further, conventional production of critical minerals is controlled by a very small number of countries which sets the stage for collusive practices such as we see being employed by substantially all of the world's oil producing countries.

Worse, even in absence of political uncertainty and or ethical conflicts, if current capabilities and projections for the future indicate that conventional, surface and subsurface mining-based techniques will not provide sufficient refined minerals required to meet essential environmental goals, e.g., to reduce or avoid the impact of climate change. As climate change impact accumulates, experts also project further limits on access to rare, essential raw materials. Merely improving the efficiency of conventional technique alone will not be sufficient to address the need for a stable supply of these critical minerals.

In addition to surface and subsurface mining-and processing of critical minerals, various efforts have been made to refine these minerals using electrochemical approaches, such as reverse current electrolysis. However, as with surface and subsurface mining-based techniques, these electrochemical approaches remain so energy intensive as to be non-viable long-term solutions for mineral refinement.

Still other approaches such as evaporation, nanofiltration, chemical precipitation, solvent-based extraction, and direct lithium extraction are too inefficient to meet growing demand for rare minerals (particularly lithium) and involve use of harmful substances (such as organic solvents, corrosive solvents, strong acids, lime, etc.), and/or consume exorbitant amounts of water.

Accordingly, alternative sources and techniques for obtaining valuable minerals, in refined form, are necessary to reduce environmental impact and financial costs associated with conventional mining and refinement.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter. Moreover, the systems, methods, and devices of this disclosure each have several innovative aspects, no single one of which is solely responsible for the desirable attributes disclosed herein.

Various implementations of the subject matter disclosed herein relate generally to apparatuses, methods, and various compositions relating to production of refined minerals, particularly elemental lithium. The apparatuses are shown and discussed as may be relevant to controlled usage of a dissociative reactor apparatus to produce various dissociated species of a desired composition from corresponding salts, referred to generally and in the present disclosure as "brine-fed reactors". The environment within these brine-fed reactors is controlled so that preferred species are collected from among the dissociated species, for advantageous and economically viable use in myriad downstream applications, including but not limited to energy storage.

According to one aspect, a method for refining one or more critical minerals, using a dissociating reactor includes: receiving, at the dissociating reactor, one or more input materials, wherein the one or more input materials comprise at least one salt including one or more critical mineral components; dissociating, using the dissociating reactor, the at least one salt into a plurality of dissociated species, wherein the dissociated species comprise at least one refined critical mineral; and collecting the at least one refined critical mineral.

In one approach, the foregoing aspect may further include separating the at least one refined critical mineral from one or more gases produced in the dissociating reactor during refinement of the at least one refined critical mineral.

Moreover, the one or more critical mineral components may be metal components of the one or more salts. For instance, the one or more salts may include halides, hydroxides, oxides, and/or carbonates of the at least one refined critical mineral. The at least one refined critical mineral is preferably selected from the group consisting of: elemental lithium, elemental sodium, elemental calcium, elemental magnesium, elemental copper, elemental carbon, and combinations thereof.

Dissociating the input materials into the plurality of dissociated species is preferably driven at least in part by pulsed microwave energy generated by the dissociating reactor. In some approaches, dissociating the at least one salt into a plurality of dissociated species is driven by energy generated using a renewable energy source and/or a renewable energy power plant. The renewable energy source may include a geothermal energy source, or the renewable energy power plant comprises a geothermal power plant. Preferably, the geothermal power plant is powered by an aqueous source from which the input materials are obtained via aqueous mining, and the aqueous source is co-located with the geothermal power plant.

Collecting the at least one refined critical mineral preferably includes capturing the at least one refined critical mineral using at least one selective getter material, and the at least one selective getter material may be selected from the group consisting of: tantalum, tungsten, iron phosphate, silicon, activated carbon, nickel monoxide, zeolites, metal foams, and combinations thereof. Preferably, the at collected least one refined critical mineral is characterized by an absence of faceted defects on one or more surfaces thereof.

In still more approaches, the foregoing aspect may include passivating at least some of the at least one refined critical mineral produced in the dissociating reactor either during refinement of the at least one refined critical mineral, or after refinement of the at least one refined critical mineral.

According to another aspect, a method for substantially continuous refinement of one or more critical minerals using a dissociating reactor includes: receiving, at a dissociating reactor, one or more input materials, wherein the input materials comprise at least one salt including one or more critical mineral components; refining, using the dissociating reactor, the at least one salt into at least one refined critical mineral, wherein the refining comprises capturing at least some of the at least one refined critical mineral using at least one getter material present in the dissociating reactor during refinement of the at least one refined critical mineral; shutting down the dissociating reactor for a scheduled maintenance operation unrelated to the getter material; replacing or exchanging the at least one getter material while the scheduled maintenance operation is performed on the dissociating reactor; and resuming normal operation of the dissociating reactor.

In preferred approaches, replacing or exchanging the at least one getter material does not add any additional downtime to a regular operating schedule of the dissociating reactor, or does not require opening of the dissociating reactor. For example, replacing or exchanging the at least one getter material may be performed via a getter access mechanism of the dissociating reactor.

The method for substantially continuous refinement of critical minerals may additionally include collecting the refined critical minerals. Collecting the at least one refined critical mineral preferably includes capturing the at least one refined critical mineral using at least one selective getter material, and the at least one selective getter material may be selected from the group consisting of: tantalum, tungsten, iron phosphate, silicon, activated carbon, nickel monoxide, zeolites, metal foams, and combinations thereof. Preferably, the at collected least one refined critical mineral is characterized by an absence of faceted defects on one or more surfaces thereof.

In still more approaches, the foregoing aspect may include passivating at least some of the at least one refined critical mineral produced in the dissociating reactor either during refinement of the at least one refined critical mineral, or after refinement of the at least one refined critical mineral.

According to yet another aspect, a getter cartridge configured to facilitate continuous operation of a dissociating reactor during refinement of critical minerals from input material includes: a body having an outer portion and an inner portion; one or more engaging components disposed along the outer portion of the body, wherein the one or more engaging components are configured to physically engage a dissociating reactor body and secure the getter cartridge therein; one or more getter material regions disposed along the inner portion of the body, each getter material regions comprising at least one getter material; and a getter access mechanism configured to engage the dissociating reactor body and provide direct access to the one or more getter material regions from outside the dissociating reactor body without opening the dissociating reactor.

Preferably, the inner portion is configured to rotate about a principal axis of the body, and rotating the inner portion facilitates access to different ones of the one or more getter outer portion of the getter cartridge may be substantially concentric cylinders.

The one or more engaging components may be, or include, a plurality of rails configured to engage with a plurality of corresponding slots disposed along an inner portion of the reactor body.

Moreover, the one or more getter material regions may each independently comprise a porous substrate having one or more of the at least one getter material disposed in pores thereof; one or more of the at least one getter material disposed on one or more surfaces thereof; or both. Each getter material region may independently comprise a removable filter comprising the at least one getter material. In addition, the at least one getter material is preferably present in sufficient amount to effectively getter one or more compounds, produced in the dissociating reactor body during refinement of critical minerals, for a duration at least as long as a regularly scheduled operational period of the dissociating reactor. The at least one getter material may be selected from the group consisting of: tantalum, tungsten, iron phosphate, silicon, nickel monoxide, activated carbon one or more zeolites, metal foams, and combinations thereof.

Further still, the one or more getter material regions comprise first getter material regions and second getter material regions, and the at least one getter material of the first getter material regions is configured to capture either the critical minerals or derivatives thereof. The at least one getter material of the second getter material regions is preferably configured to capture: one or more dissociated species of the input material that are generated during refinement of the critical minerals using the dissociating reactor, one or more byproducts of chemical reactions taking place in the dissociating reactor during refinement of the critical minerals, or both the one or more dissociated species of the input material and the one or more byproducts of the chemical reactions.

The second getter material regions may be positioned upstream of the first getter material regions along a length of the getter cartridge, particularly where at least one getter material of the second getter material regions is configured to capture: one or more dissociated species of the input material that are generated during refinement of the critical minerals using the dissociating reactor, one or more byproducts of chemical reactions taking place in the dissociating reactor during refinement of the critical minerals, or both. Positioning the second getter material regions upstream of the first getter material regions improves collection of refined critical minerals or derivatives thereof as the environment is not polluted by the byproducts or dissociated species other than of the critical mineral.

The first and second getter material regions may be arranged in alternating fashion around the inner circumference of the inner portion of the body. For instance, the first getter material regions may include a plurality of beds of at least one first getter material, and wherein the second getter material regions comprise a plurality of beds of at least one second getter material, arranged in alternating fashion around the inner circumference of the inner portion of the body. Additionally, some or all of the plurality of beds of the at least one first getter material may extend from the inner circumference of the inner portion of the body toward a center of the inner portion of the body, and/or some or all of the plurality of beds of the at least one second getter material may extend from the inner circumference of the inner portion of the body toward a center of the inner portion of the body.

Details of one or more implementations of the subject matter described in this disclosure are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Implementations of the subject matter disclosed herein are illustrated by way of example and are not intended to be limited by the figures of the accompanying drawings. Like numbers reference like elements throughout the drawings and specification. Note that the relative dimensions of the following figures may not be drawn to scale.

DETAILED DESCRIPTION

Overview

Figure 1:
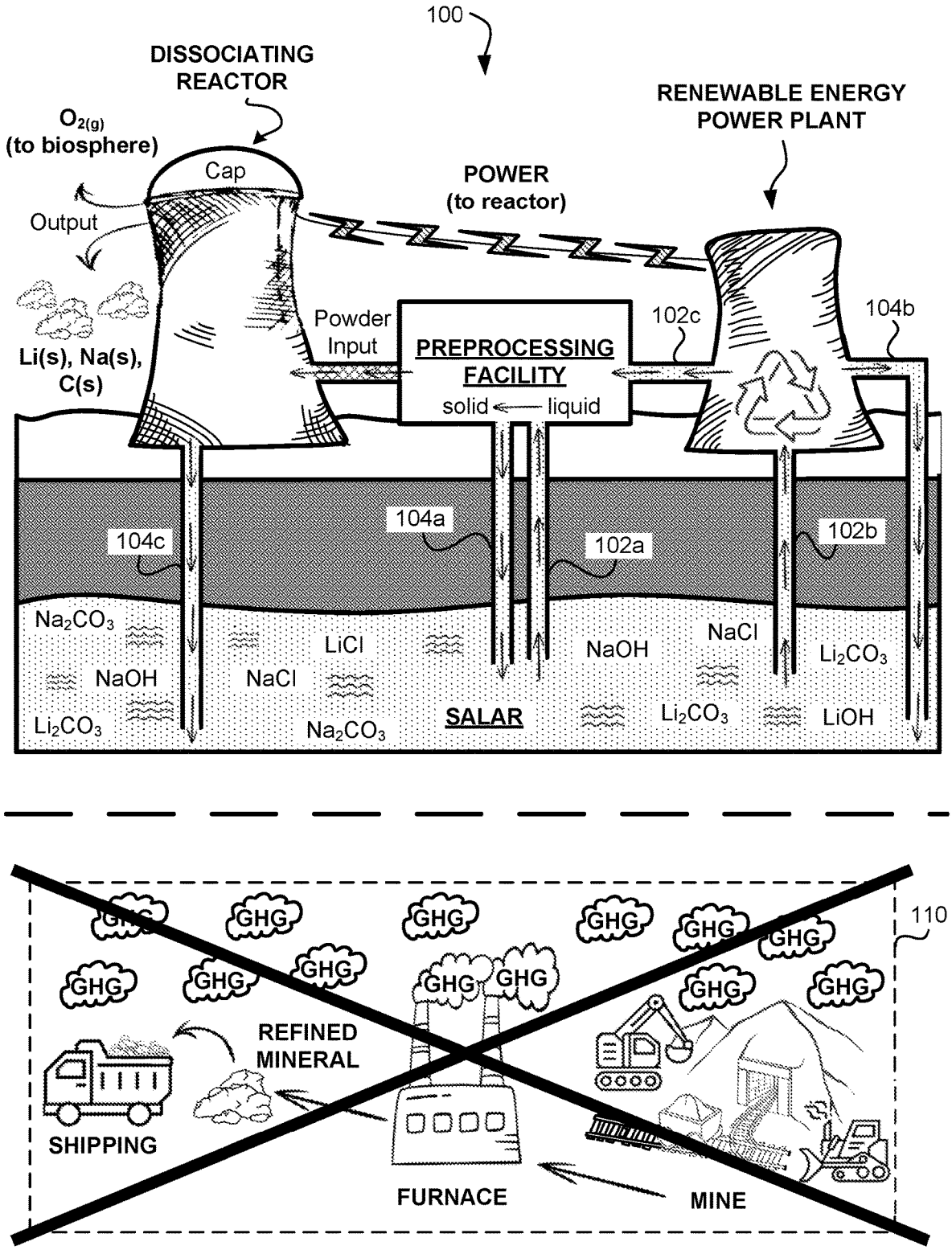
FIG. 1 is a simplified diagram of an inventive apparatus configuration and process for aqueous mining of critical minerals, especially refined metals exhibiting high ionic conductivity. The inventive aqueous mining apparatus configuration and process are juxtaposed against a simplified diagram depicting conventional surface and/or subsurface mining-based techniques for obtaining and refining valuable materials, for comparison.

The disclosure herein describes various aspects of inventive systems and techniques for aqueous mining of critical minerals such as sodium, lithium, and other minerals (particularly ionic conductors) critical for implementation and development of various green applications, including but not limited to energy storage and electric vehicle production and operation. As noted above, the inventive aqueous mining systems and processes advantageously avoid wasteful energy use and environmentally harmful pollution associated with conventional surface mining and subsurface mining approaches.

Instead, alternative sources of critical minerals (such as salts) are obtained directly from an aqueous source, such as lakes, aquifers, streams, rivers, oceans, geysers, hot springs, desalinization plant, etc. as would be understood by a person having ordinary skill in the art upon reading the descriptions herein), particularly aqueous sources containing a high concentration (e.g., 1-100 ppm) of salt(s) that include the critical mineral as a component (typically the metal component).

The salts are processed using plasma-based techniques to directly synthesize critical minerals from the salts, e.g., elemental lithium, elemental sodium, etc. The plasma-based processing techniques may also generate solid carbon, which may be used in various green applications such as energy storage, carbon fiber-based material production, etc., and/or gaseous oxygen, which may be released into the biosphere for beneficial environmental impact.

Plasma-based processing of materials has emerged as a preferred industrial solution. In such settings, microwaves are propagated into a reaction chamber enclosing a mixture of materials to excite the mixture and, in turn, generate a plasma. The microwave energy dissociates molecules of the mixture of materials into their constituent species. Such systems are effective since microwaves introduced into the reaction chamber operate at relatively high-power coupling efficiencies and are thus capable of supporting various dissociations such as the dissociation of methane into hydrogen and carbon and/or the refinement of and separation of constituent elemental components (e.g., lithium metal as refined from lithium salts). These plasma-based processing techniques can be advantageously employed in metal refinement situations. To explain in the context of a practical application, conventional refinement of metals that are used in the fabrication of secondary batteries involves costly and time-consuming processes involving many steps, substantial energy consumption, and results in extensive release of pollutants into the environment. This is particularly true when using legacy techniques for refining ionic conductors (e.g., lithium or sodium) that are used in secondary batteries. As such, legacy techniques are expensive, difficult to control, and require complicated processes and tools.

By leveraging dissociation pathways and chemical reactions that may be controlled using a dissociating reactor as described herein, mining critical minerals from aqueous sources (especially when driven in part or in whole by optional, co-located power plants that generate energy using renewable sources) enables efficient, environmentally friendly, conflict-neutral means to obtain the substantial amounts of such critical minerals as necessary for further environmentally-friendly applications, such as fabrication of green energy storage technology, electric vehicle production and operation, among many others.

Definitions and Use of Figures

Some of the terms used in this description are defined below for easy reference. The presented terms and their respective definitions are not rigidly restricted to these definitions—a term may be further defined by the term's use within this disclosure. The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application and the appended claims, the term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. As used herein, at least one of A or B means at least one of A, or at least one of B, or at least one of both A and B. In other words, this phrase is disjunctive. The articles "a" and "an" as used in this application and the appended claims should generally be construed to mean "one or more" unless specified otherwise or is clear from the context to be directed to a singular form.

Various implementations are described herein with reference to the figures. It should be noted that the figures are not necessarily drawn to scale, and that elements of similar structures or functions are sometimes represented by like reference characters throughout the figures. It should also be noted that the figures are only intended to facilitate the description of the disclosed implementations—they are not representative of an exhaustive treatment of all possible implementations, and they are not intended to impute any limitation as to the scope of the claims. In addition, an illustrated implementation need not portray all aspects or advantages of usage in any particular environment.

An aspect or an advantage described in conjunction with a particular implementation is not necessarily limited to that implementation and can be practiced in any other implementations even if not so illustrated. References throughout this specification to "some implementations" or "other implementations" refer to a particular feature, structure, material, or characteristic described in connection with the implementations as being included in at least one implementation. Thus, the appearance of the phrases "in some implementations" or "in other implementations" in various places throughout this specification are not necessarily referring to the same implementation or implementations. The disclosed implementations are not intended to be limiting of the claims.

General Aspects

According to one aspect, a method for refining one or more critical minerals, using a dissociating reactor includes: receiving, at the dissociating reactor, one or more input materials, wherein the one or more input materials comprise at least one salt including one or more critical mineral components; dissociating, using the dissociating reactor, the at least one salt into a plurality of dissociated species, wherein the dissociated species comprise at least one refined critical mineral; and collecting the at least one refined critical mineral.

In one approach, the foregoing aspect may further include separating the at least one refined critical mineral from one or more gases produced in the dissociating reactor during refinement of the at least one refined critical mineral.

Moreover, the one or more critical mineral components may be metal components of the one or more salts. For instance, the one or more salts may include halides, hydroxides, oxides, and/or carbonates of the at least one refined critical mineral. The at least one refined critical mineral is preferably selected from the group consisting of: elemental lithium, elemental sodium, elemental calcium, elemental magnesium, elemental copper, elemental carbon, and combinations thereof.

Dissociating the input materials into the plurality of dissociated species is preferably driven at least in part by pulsed microwave energy generated by the dissociating reactor. In some approaches, dissociating the at least one salt into a plurality of dissociated species is driven by energy generated using a renewable energy source and/or a renewable energy power plant. The renewable energy source may include a geothermal energy source, or the renewable energy power plant comprises a geothermal power plant. Preferably, the geothermal power plant is powered by an aqueous source from which the input materials are obtained via aqueous mining, and the aqueous source is co-located with the geothermal power plant.

Collecting the at least one refined critical mineral preferably includes capturing the at least one refined critical mineral using at least one selective getter material, and the at least one selective getter material may be selected from the group consisting of: tantalum, tungsten, iron phosphate, silicon, activated carbon, nickel monoxide, zeolites, metal foams, and combinations thereof. Preferably, the at collected least one refined critical mineral is characterized by an absence of faceted defects on one or more surfaces thereof.

In still more approaches, the foregoing aspect may include passivating at least some of the at least one refined critical mineral produced in the dissociating reactor either during refinement of the at least one refined critical mineral, or after refinement of the at least one refined critical mineral.

According to another aspect, a method for substantially continuous refinement of one or more critical minerals using a dissociating reactor includes: receiving, at a dissociating reactor, one or more input materials, wherein the input materials comprise at least one salt including one or more critical mineral components; refining, using the dissociating reactor, the at least one salt into at least one refined critical mineral, wherein the refining comprises capturing at least some of the at least one refined critical mineral using at least one getter material present in the dissociating reactor during refinement of the at least one refined critical mineral; shutting down the dissociating reactor for a scheduled maintenance operation unrelated to the getter material; replacing or exchanging the at least one getter material while the scheduled maintenance operation is performed on the dissociating reactor; and resuming normal operation of the dissociating reactor.

In preferred approaches, replacing or exchanging the at least one getter material does not add any additional downtime to a regular operating schedule of the dissociating reactor, or does not require opening of the dissociating reactor. For example, replacing or exchanging the at least one getter material may be performed via a getter access mechanism of the dissociating reactor.

The method for substantially continuous refinement of critical minerals may additionally include collecting the refined critical minerals. Collecting the at least one refined critical mineral preferably includes capturing the at least one refined critical mineral using at least one selective getter material, and the at least one selective getter material may be selected from the group consisting of: tantalum, tungsten, iron phosphate, silicon, activated carbon, nickel monoxide, zeolites, metal foams, and combinations thereof. Preferably, the at collected least one refined critical mineral is characterized by an absence of faceted defects on one or more surfaces thereof.

In still more approaches, the foregoing aspect may include passivating at least some of the at least one refined critical mineral produced in the dissociating reactor either during refinement of the at least one refined critical mineral, or after refinement of the at least one refined critical mineral.

According to yet another aspect, a getter cartridge configured to facilitate continuous operation of a dissociating reactor during refinement of critical minerals from input material includes: a body having an outer portion and an inner portion; one or more engaging components disposed along the outer portion of the body, wherein the one or more engaging components are configured to physically engage a dissociating reactor body and secure the getter cartridge therein; one or more getter material regions disposed along the inner portion of the body, each getter material regions comprising at least one getter material; and a getter access mechanism configured to engage the dissociating reactor body and provide direct access to the one or more getter material regions from outside the dissociating reactor body without opening the dissociating reactor.

Preferably, the inner portion is configured to rotate about a principal axis of the body, and rotating the inner portion facilitates access to different ones of the one or more getter outer portion of the getter cartridge may be substantially concentric cylinders.

The one or more engaging components may be, or include, a plurality of rails configured to engage with a plurality of corresponding slots disposed along an inner portion of the reactor body.

Moreover, the one or more getter material regions may each independently comprise a porous substrate having one or more of the at least one getter material disposed in pores thereof; one or more of the at least one getter material disposed on one or more surfaces thereof; or both. Each getter material region may independently comprise a removable filter comprising the at least one getter material. In addition, the at least one getter material is preferably present in sufficient amount to effectively getter one or more compounds, produced in the dissociating reactor body during refinement of critical minerals, for a duration at least as long as a regularly scheduled operational period of the dissociating reactor. The at least one getter material may be selected from the group consisting of: tantalum, tungsten, iron phosphate, silicon, nickel monoxide, activated carbon one or more zeolites, metal foams, and combinations thereof.

Further still, the one or more getter material regions comprise first getter material regions and second getter material regions, and the at least one getter material of the first getter material regions is configured to capture either the critical minerals or derivatives thereof. The at least one getter material of the second getter material regions is preferably configured to capture: one or more dissociated species of the input material that are generated during refinement of the critical minerals using the dissociating reactor, one or more byproducts of chemical reactions taking place in the dissociating reactor during refinement of the critical minerals, or both the one or more dissociated species of the input material and the one or more byproducts of the chemical reactions.

The second getter material regions may be positioned upstream of the first getter material regions along a length of the getter cartridge, particularly where at least one getter material of the second getter material regions is configured to capture: one or more dissociated species of the input material that are generated during refinement of the critical minerals using the dissociating reactor, one or more byproducts of chemical reactions taking place in the dissociating reactor during refinement of the critical minerals, or both. Positioning the second getter material regions upstream of the first getter material regions improves collection of refined critical minerals or derivatives thereof as the environment is not polluted by the byproducts or dissociated species other than of the critical mineral.

The first and second getter material regions may be arranged in alternating fashion around the inner circumference of the inner portion of the body. For instance, the first getter material regions may include a plurality of beds of at least one first getter material, and wherein the second getter material regions comprise a plurality of beds of at least one second getter material, arranged in alternating fashion around the inner circumference of the inner portion of the body. Additionally, some or all of the plurality of beds of the at least one first getter material may extend from the inner circumference of the inner portion of the body toward a center of the inner portion of the body, and/or some or all of the plurality of beds of the at least one second getter material may extend from the inner circumference of the inner portion of the body toward a center of the inner portion of the body.

Moreover, in various implementations, the foregoing aspects may include any of the following components, configurations, features, physical characteristics, properties, etc. as would be understood by a person having ordinary skill in the art upon reading the present disclosure. Moreover, these components, configurations, features, physical characteristics, properties, etc., may, according to different embodiments, be included in different combinations or permutations, without limitation.

Descriptions Of Exemplary Implementations

FIG. 1 depicts a simplified schematic 100 of a configuration suitable for green, conflict-free, on-site refinement of valuable materials from aqueous sources (e.g., salars, aquifers, desalinization plants, etc.) using a dissociating reactor, according to one implementation. FIG. 1 also shows a simplified schematic 110 of a conventional surface mining or subsurface mining, refinement, and distribution-based approach to obtaining refined minerals, as known in the art.

According to the exemplary schematic 100 shown in FIG. 1, the inventive configuration includes a DISSOCIATING REACTOR co-located at the site of a SALAR or other aqueous source of desired salts, preferably co-located near an (optional) RENEWABLE ENERGY POWER PLANT. The RENEWABLE ENERGY POWER PLANT is used to provide electric energy needed to dissociate ionic species in salt solution into various related subspecies (particularly elemental form(s) of the metal component(s) of the salt solution) without incurring negative environmental impact. While the input energy required to drive dissociation may vary according to the configuration of DISSOCIATING REACTOR and while the nature of the species to be dissociated from saline solution may vary, according to one experimental implementation an energy-producing facility output on the order of about 100 megawatts or more is sufficient to drive dissociation of desired species and refinement thereof into desired critical minerals, such as solid, elemental lithium ($Li_{(s)}$), sodium ($Na_{(s)}$), or other critical minerals as described herein. Also preferable, but optional, at least the DISSOCIATING REACTOR is capped.

In addition, a PREPROCESSING FACILITY is "upstream" of the DISSOCIATING REACTOR, and fluidically coupled to the SALAR or other aqueous source, the DISSOCIATING REACTOR, and the RENEWABLE ENERGY POWER PLANT (where present). The PREPROCESSING FACILITY includes an inlet 102*a* and an outlet 104*a* each fluidically coupled to the SALAR or other aqueous source, and configured to draw up or return aqueous (e.g., saline) solution to and from the SALAR, respectively. Optionally, the PREPROCESSING FACILITY may receive aqueous solution from the RENEWABLE ENERGY POWER PLANT, e.g., via optional inlet 102*c* as shown in FIG. 1.

As further indicated in FIG. 1, and described in greater detail hereinbelow with reference to FIGS. 7-9, the PREPROCESSING FACILITY is configured to perform two basic functions (although other functionality is certainly within the scope of the presently described inventive concepts.

First, the PREPROCESSING FACILITY is configured to extract or enrich desired components of refined critical minerals (e.g., lithium, sodium, carbon, etc.) from the input saline solution (i.e., in liquid form). For instance, enrichment and/or extraction of desired components of refined critical minerals may include converting raw materials (e.g., saline solution) into suitable salt(s), which in turn may involve precipitating salts from solution, and/or converting one salt (e.g., a halide, hydroxide, carbonate, etc.) into another (e.g., substituting metal or non-metal components of one salt for corresponding metal or non-metal components of another salt, such as converting lithium chloride or lithium hydroxide into lithium carbonate via substitution of lithium into a sodium carbonate stock, followed by collection of the lithium carbonate (leaving sodium chloride or sodium hydroxide to be collected or returned to the aqueous source).

Second, the PREPROCESSING FACILITY is configured to convert extracted/enriched components of refined critical minerals (e.g., salts) into suitable form for input into DISSOCIATING REACTOR. Again, as described in greater detail hereinbelow, e.g., with reference to FIG. 9, conversion of components into suitable form for input into the DISSOCIATING REACTOR may involve grinding the extracted or enriched components into a powder having desired characteristics (e.g., into particles having a principal dimension in a range from 10 nm to 50 microns, into particles having desired mass, density, or electronic characteristics such as surface charge, etc. as would be understood by a person having ordinary skill in the art upon reading the present disclosure). Conversion of extracted or enriched components may optionally include separating the (powderized) components from undesired materials (e.g., other solids, gases, or remnant liquid from the material as obtained from the aqueous source), and/or combining the powderized components with a carrier fluid, e.g., to form a slurry, suspension, or other suitable fluidic input for the DISSOCIATING REACTOR. Preferably, the carrier fluid is gaseous, allowing injection of dry material into the DISSOCIATING REACTOR to maximize efficiency of converting input material into dissociated components. The fluidic input may be injected into the DISSOCIATING REACTOR as part of a fluidic flow, and various components thereof dissociated into constituent species in the presence of the non-equilibrium plasma.

It shall be understood that the PREPROCESSING FACILITY includes any and all requisite equipment, consumable materials, etc. configured in a manner suitable to perform the foregoing extraction/enrichment and conversion functionalities. Various embodiments of the inventive concepts presented herein may employ equipment configures substantially as shown in FIGS. 7-9, or any suitable alternative thereof that would be appreciated by a person having ordinary skill in the art upon reviewing these descriptions. For instance, in one approach powderizing materials may be performed using an atomizer or other equivalent means for producing particles having suitable characteristics such as described above.

In a preferred approach, pre-processing facility may employ one or more separation membranes to accomplish separation of desired species of critical minerals from each other, and/or from other undesired components of the saline solution. For instance, as described hereinbelow with respect to FIGS. 7-8, the pre-processing facility includes one or more separation membranes configured, e.g., via size exclusion and/or ion separation, to separate at least sodium, lithium, and potassium ions present in a saline solution from one another. In one approach, prior to injection into the DISSOCIATING REACTOR, the separated ions may be converted into salts, e.g., carbonates, hydroxides, etc. as described elsewhere herein, and converted into a slurry.

Of course, those having ordinary skill in the art will appreciate that the foregoing exemplary configuration and components for pre-processing saline solution to extract desired critical minerals (or salts thereof), and converting said extracted products into a suitable form for injection into DISSOCIATING REACTOR are provided by way of illustration only, and are not limiting on the presently described inventive concepts. Any suitable equivalent apparatus(es), configuration(s), and/or techniques for pre-processing saline solution to extract desired critical minerals (or salts thereof), and converting said extracted products into a suitable form for injection into DISSOCIATING REACTOR may be employed without departing from the scope of the inventive embodiments described herein.

Referring again to FIG. 1, each of the DISSOCIATING REACTOR and the RENEWABLE ENERGY POWER PLANT (where present) include an inlet 102*a*, 102*b*, respectively, and an outlet 104*c*, 104*b* (again, respectively). The respective inlets 102*a*, 102*b* are disposed in or otherwise fluidically coupled to the SALAR or other aqueous source in a manner effective to draw up saline solution therefrom. In addition, the PREPROCESSING FACILITY includes an optional inlet 102*c* fluidically coupled to the RENEWABLE ENERGY POWER PLANT, and configured to provide saline solution (also referred to herein as "brine") to the PREPROCESSING FACILITY for preprocessing as described above, and with greater detail regarding FIGS. 7-9 below.

However, it shall be understood that the RENEWABLE ENERGY POWER PLANT, associated inlet 102*b* and outlet 104*b*, while preferred, may be omitted without departing from the scope of the inventive concepts presented herein. In any event, skilled artisans will appreciate that DISSOCIATING REACTOR, PREPROCESSING FACILITY, and optional RENEWABLE ENERGY POWER PLANT include suitable inlet(s) and/or outlet(s) to obtain aqueous solution from, and return output aqueous solution to, the SALAR or other aqueous source, according to various embodiments. However, the outlet 104*c* of DISSOCIATING REACTOR need not be disposed in the SALAR, in some implementations. For instance, the outlet 104*c* may be coupled to a collection source, e.g., if there is concern of contaminating the SALAR or other aqueous source with the output from the DISSOCIATING REACTOR.

Furthermore, shown in FIG. 1, but in no way limiting on the scope of the inventive concepts presented herein, the refined minerals include solid, elemental lithium ($Li_{(s)}$); solid, elemental sodium ($Na_{(s)}$); solid, elemental calcium (Cads)); solid, elemental magnesium ($Mg_{(s)}$); solid, elemental copper ($Cu_{(s)}$); solid, elemental carbon ($C_{(s)}$), etc., or combinations thereof. In various alternatives, the output from DISSOCIATING REACTOR may include other materials such as gaseous oxygen ($O_{2(g)}$) and/or other gases (such as chlorine ($Cl_{2(g)}$) which may be returned to the SALAR or collected in an appropriate container).

For comparison/contrast to the inventive techniques depicted schematically in schematic 100, a conventional surface and subsurface mining, refinement, and distribution schematic 110 is shown in the lower portion of FIG. 1. In brief, and as well documented, raw materials (typically ore) are mined from a MINE, which typically includes extensive use of heavy equipment and corresponding undesirable consumption of non-renewable energy and production of environmentally unfriendly by-product such as various oxides of carbon, nitrogen, sulfur, and/or other "greenhouse gases" (GHG) as understood by persons having ordinary skill in the art.

These raw materials require refinement of one form or another at a suitable facility, such as a FURNACE. For instance, refinement of ore typically requires smelting the ore, or solvating components of the ore in (typically harsh) aqueous solutions, such as acids, etc. as understood in the art. These processes result in further release of additional GHG and harm to the environment.

Moreover, transporting the raw materials from the MINE to the FURNACE further exacerbates negative environmental impact, resource consumption, and economic cost of the conventional (e.g., surface mining and subsurface mining-based) approaches. Similarly, shipping the resulting refined minerals, e.g., to distributors who also must ultimately deliver said materials to end-point customers, even further exacerbates negative environmental impact, resource consumption, and economic cost of the surface mining and subsurface mining-based approaches.

Accordingly, the presently disclosed inventive concepts, as represented according to one implementation by schematic 100, obviate the conventional techniques such as shown in schematic 110. In particular, the inventive techniques and corresponding systems disclosed herein avoid the release of GHG associated with mining, refining, and distributing refined materials. Additionally, in some approaches, chlorine gas may be released according to these conventional techniques, but not by the inventive approaches described herein.

Instead, the output of inventive aqueous mining-based approaches is simply the refined mineral(s), with optional output of solid carbon (C(s)) and/or gaseous oxygen (02(*g*)). The lattermost may be released into the biosphere for beneficial environmental impact, rendering aqueous mining techniques a truly green approach to obtaining refined critical minerals that may, in turn, be put to use in further green applications. For instance, in some approaches undesired components of the output may be exhausted into a nearby aqueous source, or a dedicated collection container (e.g., containing aqueous solution to absorb/solvate unwanted byproducts).

Dissociating Reactor

Figure 2:
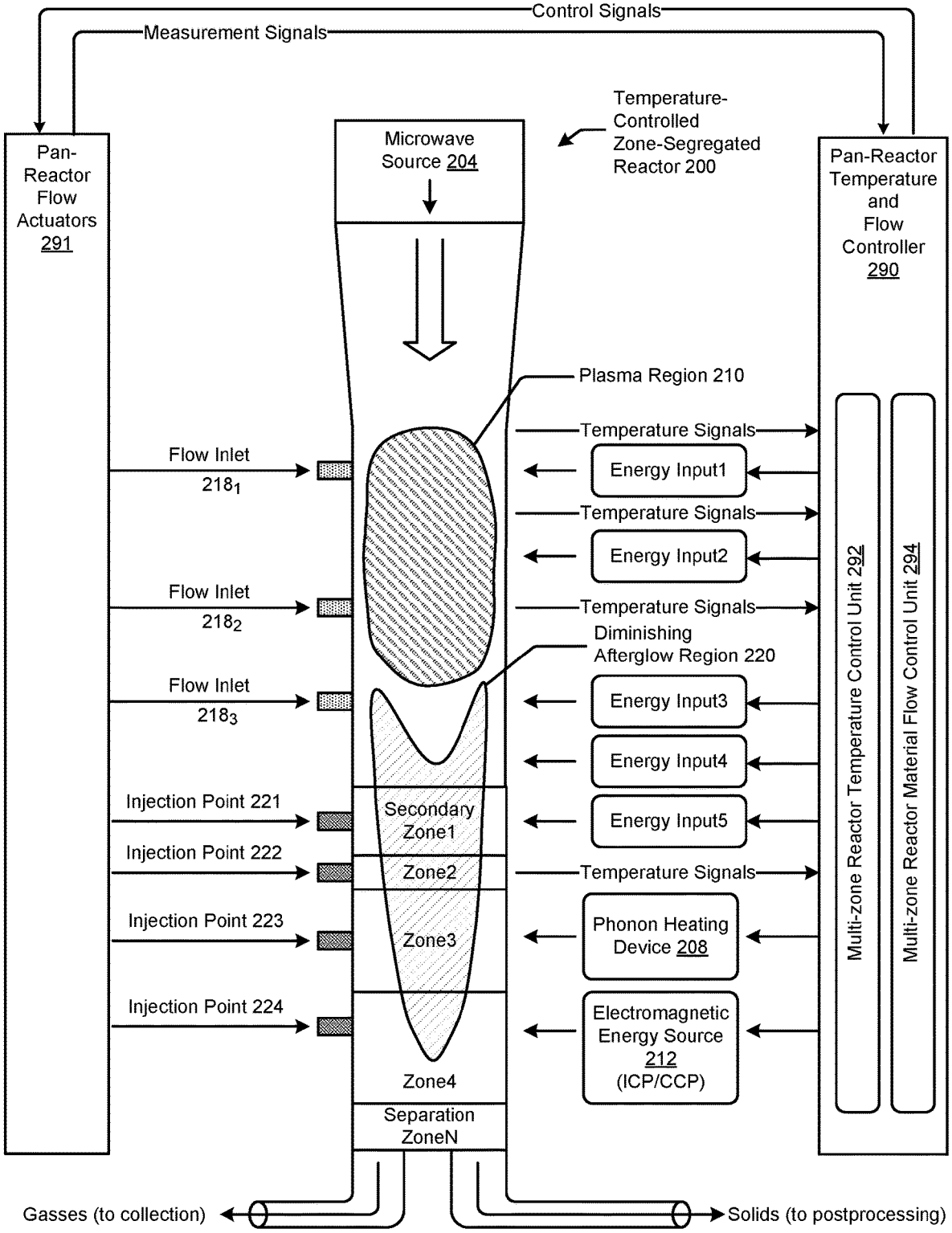
FIG. 2 shows a schematic of a temperature-controlled, zone-segregated reactor (also referred to herein as a "dissociating reactor"), according to one implementation.

FIG. 2 shows a schematic of a modular microwave materials refining system having a having a pan-reactor control system and a gas/solids separation facility. As shown, the temperature-controlled zone-segregated reactor 200 (also referred to herein, and shown in FIG. 1 as a "dissociating reactor") includes a microwave source 204, a plasma region 210, and a diminishing afterglow region 220. In turn, the microwave source 204 is preferably coupled to a waveguide such as a field-enhancing waveguide (FEWG) and configured to direct microwave energy from the microwave source 204 into the body of the reactor 200, as indicated by the downward arrow in FIG. 2. The dimensions of the different portions of the waveguide arc set according to the microwave frequency. For example, for an elliptical waveguide the cross-sectional dimensions can be 5.02 inches by 2.83 inches to generate microwave energy having a frequency in a range from about 2.1 GHz to about 2.7 GHz.

Among other elements not shown for simplicity, a microwave circuit controls a pulsing frequency at which microwave energy from microwave energy source 204 is pulsed. The microwave energy from microwave energy source 204 is continuous wave, according to preferred implementations.

A plasma is generated from a supply gas in a plasma region 210 of the reactor 200, and a reaction length of the waveguide serves as a reaction zone to separate the process material into separate (i.e., dissociated) components. The present reactor 200 as demonstrated by FIG. 2 is preferably absent of a dielectric barrier between the field-enhancing zone of the field-enhancing waveguide and the reaction zone. In contrast, the reaction zones of conventional systems are enclosed within a dielectric barrier such as a quartz chamber. The direction of propagation of the microwave energy, as indicated by the downward arrow in FIG. 2, is parallel to the majority of the flow of the supply gas and/or the process material, and the microwave energy enters the waveguide upstream of the portion of the reactor 200 where the dissociated components are generated.

In the vicinity of plasma region 210, reactor 200 includes three flow inlets 2181, 2182, and 2183 fluidically coupled thereto and configured to flow input materials (including, e.g., the aforementioned supply gas, sources of critical minerals (such as saline solutions including salts of the critical minerals), etc.) into the reactor 200 at specified locations, e.g., at different points along the plasma region 210 as shown in FIG. 2. Moreover, each flow inlet is configured to independently control the amount of material introduced into the respective region of reactor 200 to which the inlet is coupled.

With continuing reference to FIG. 2, the reactor 200 includes one or more energy sources energetically coupled to one or more zones of the diminishing afterglow region 220. As shown in FIG. 2, these energy sources include a phonon heating device 208 and an electromagnetic energy source 212 (e.g., an ICP or CCP device). The phonon heating device 208 is coupled to a secondary zone (Zone3) of the diminishing afterglow region 220, while the electromagnetic energy source 212 is coupled to another secondary zone (Zone4) of diminishing afterglow region 220. However, skilled artisans will appreciate upon reading the present disclosure that reactor 200 includes implementations in which the aforementioned energy sources are coupled to different portions of the diminishing afterglow region 220, as well as implementations in which different, or additional, energy sources may be present, such as an ohmic heating device, a dielectric heating device, a microwave energy device, and/or a light energy source. The various energy sources, according to myriad configurations of reactor 200, may be included in any combination or permutation, and may be coupled to any portion of the reactor 200, especially diminishing afterglow region 220, without departing from the scope of the presently described inventive concepts. For instance, different energy sources may be coupled to different portions of reactor 200 in order to facilitate tuning of conditions within the reactor so as to generate desired dissociated species of input materials (especially materials containing critical minerals) at predetermined locations within the reactor 200.

The one or more energy sources may include, or be coupled to, one or more secondary zones, e.g., secondary zone1, zone2, zone3, and Zone4 as shown in FIG. 2. The one or more secondary zones may be independently configured to generate a secondary, a tertiary, a quaternary, etc. microwave energy. In some aspects, the one or more energy sources may be configured to adjust a pulsing frequency of the secondary, tertiary, quaternary, etc. microwave energy or energies. In other aspects, the one or more energy sources may be configured to adjust a pulsing duty cycle of the secondary, tertiary, quaternary, etc. microwave energy or energies. In some other aspects, the one or more energy sources may be configured to adjust a pulsing shape of the secondary, tertiary, quaternary, etc. microwave energy or energies. In some other aspects, the one or more energy sources may be configured to adjust selectively pulse an output power level of the secondary, tertiary, quaternary, etc. microwave energy or energies.

The energy sources, including phonon heating device 208 and electromagnetic energy source 212 (but optionally including one or more additional energy sources such as discussed above, not shown for simplicity) can be optionally coupled to a pan-reactor temperature and flow controller 290. The flow controller 290 is in turn coupled with a bank of pan-reactor flow actuators 291. Moreover, a series of temperature measurements (such as an embodied by the shown temperature signals) are coupled to the pan-reactor temperature and flow controller 290 can control any one or more of the energy sources based at least in part on the temperature measurements. As such temperatures within the reactor can be controlled to a fine degree across all zones, and within all regions of the reactor.

In addition to flow inlets 2181, 2182, and 2183, this particular embodiment includes a series of injection points (e.g., injection point 221, injection point 222, injection point 223, and injection point 224) that are disposed along the length of the temperature-controlled zone-segregated reactor 200. The injection points are purposely positioned at different points along the length of the temperature-controlled zone-segregated reactor and configured (e.g., with respect to input constituency, input temperatures, flow rates, etc.) so as to be able to control injection of materials into particular zones of the afterglow region.

Different injected materials may be optionally introduced at a certain temperature (e.g., at a particularly set and controlled introduction temperature) and/or at a certain location where the reactions within the diminishing afterglow region 220 are at a particular vaporized elemental or molecular state.

For example, when refining into pure lithium from an effluent source of a lithium-containing compound (e.g., a flow of lithium hydroxide, LiOH; a flow of lithium chloride, LiCl; a flow of lithium carbonate, $Li_2CO_3$, etc. as would be understood by a person having ordinary skill in the art upon reading the present disclosure), or an effluent source of other critical mineral-containing compounds (particularly critical minerals that function as ionic conductors and can be found in natural aqueous sources on or near the Earth's surface, such as sodium, magnesium, calcium, copper, etc.) it may be optimal to introduce a pre-heated adsorption agent into a zone where the constituents of the lithium-containing compound have dissociated, but have not cooled so much that the constituents reform back into the mineral-containing compound, or a related species that "re-traps" the critical mineral, e.g., in salt form.

Again, while the foregoing example uses lithium-containing compounds as the exemplary type of critical mineral-containing material, according to various aspects the presently disclosed inventive concepts may be equally applied to refining other pure critical minerals, particularly ionic conductors such as sodium, calcium, magnesium, etc. as described herein as well as equivalents thereof that would be understood by a person having ordinary skill in the art upon reading this disclosure. Preferably, such critical material-containing materials include salts that may be found in various aqueous sources (more preferably, as dissolved salts). Moreover, in certain embodiments, such as salts containing carbon (e.g., carbonate, $CO_3^{2-}$), the output of refining critical minerals may include solid carbon, e.g., in the form of graphene.

The ability to independently control the material flows while at the same time controlling the thermal plume energy sources along plasma column length leads to the ability to control the energy levels within the plasma region 210, which in turn leads to controllable selection of one or more reaction pathways that occur during conversion of the introduced materials into specific separated components. However, certain reaction pathways that occur during conversion of the introduced materials into specific separated components need a longer pathway and/or longer times being spent in the pathway and/or different temperature ranges along the pathway such that the plasma column length needs to be extended. This is accommodated by provision of the reaction zone having an extended length. This is further accommodated by control of a set of thermal plume energy sources.

In particular, temperature control of regions throughout the entire length of the waveguide can be accommodated by selection, control, and positioning any of a variety of thermal plume energy sources. Strictly as an illustrative example, temperatures in plasma region 210 can be at least partially controlled by Energy Input 1 and/or Energy Input2, while temperatures in diminishing afterglow region 220 can be at least partially controlled by Energy Input3 and/or Energy Input4, and while temperatures in any of the shown secondary zones can be at least partially controlled by additional thermal plume energy source(s) (such as Energy Input5).

Different process materials require different amounts of energy to react into different separated components. In the present disclosure, the available reaction pathways can be selected by changing the average energy of the plasma. The microwave energy coupled to the plasma can be pulsed, and the average energy of the plasma, and therefore the reaction pathways, are selected by controlling the microwave energy pulse duration and frequency, duty cycle, shape, and time-averaged output power level. Additional details of tuning microwave energy in microwave chemical processing systems are disclosed in U.S. patent application Ser. No. 15/351,858, entitled "Microwave Chemical Processing" and filed on Nov. 15, 2016, which is owned by the assignee of the present application and is hereby incorporated by reference in its entirety.

The average energy in the plasma can be controlled by changing the pulse period, by choosing a pulsing frequency to achieve a desired plasma energy. Additionally, the average energy of the plasma can be controlled by controlling the duty cycle. This can be understood by contemplating the situation where the time-averaged input power and the pulse period arc both held constant and the duty cycle is varied. A shorter duty cycle will increase the magnitude of the power coupled into the chamber when the microwave energy is on. This is advantageous because a relatively low amount of power (such as time-averaged power) can be used to generate reaction products from reaction pathways that would be impossible to facilitate at the same power in a continuous wave.

The reaction pathways can be selected by controlling time-averaged power input into the plasma. For example, if the duty cycle and pulse frequency are held constant, and the power input into the microwave generator is increased, then the energy of the plasma will increase.

One preferred method of the disclosure is to use high frequency pulsing of the microwave energy. In conventional microwave plasma systems the plasma is in an equilibrium state, with both ions and electrons having similar temperatures. Equilibrium plasmas are typified by high density resulting in high electrical conductivity and temperatures of several thousand Kelvin. The high electrical conductivity results in strong absorption of the incoming microwave energy, forcing the consequently prevents further microwave energy from penetrating deeper into to propagate along the edges of the plasma near the chamber boundary. High frequency pulsing of the microwave energy has the advantage of creating a diffuse non-equilibrium plasma in which the electrons have a significantly higher energy than the ions. Among other benefits, non-equilibrium plasmas allow a high proportion of the microwave energy to penetrate into the entire volume of reaction chamber and have a low temperature, often referred to as being "cool". The low plasma temperature enables thermal control of the absorption agents independent of the plasma, including maintaining them below the plasma temperature to enable absorption the various daughter products of the injected salts. An additional benefit of employing a non-equilibrium plasma is that the reaction pathways can be selected by controlling a shape and duration of the microwave energy pulse, which enables control of the electron energy distribution (EED). Electrons are efficient excitors of vibrational states in molecules. Exciting molecular vibrational states can result in enhanced dissociation rates by providing for "step-wise or ladder" dissociation in which a vibrationally excited molecule can be dissociated through multiple collisions involving electrons, ions, and neutral species, none of which may have the dissociation energy of the molecule. The rate of energy transfer from electrons to the vibrational excitation states of molecules is a functional of electron energy. Therefore, control of the EED is critical for controlling molecular dissociation. The microwave pulse can be a rectangular wave, where the power is constant during the duration of the pulse period when the microwave is on. The pulse power may or may not constant during the duration of the pulse period when the microwave power is on. The microwave pulse can be a triangular wave, or a trapezoidal wave, or a different wave profile. The plasma can be referred to as diffuse during the time period when the high energy species exist in higher fractions (such as at the beginning of the pulse before the plasma reaches equilibrium). The microwave energy can increase over the time period where the plasma is diffuse, which increases the time average fraction of high energy species in the plasma. As described above, tuning the pulse frequency, duty cycle, and pulse shape can enable the creation of a higher fraction of higher energy species within the plasma for a given time-averaged input power. The higher energy species can enable additional reaction pathways that would otherwise not be energetically favorable.

The techniques above can be further understood by using methane (CH4) as an example process material, to be separated into hydrogen and nanoparticulate carbon. Typically, 4-6 eV is needed to dissociate methane (CH4). While some electrons may have energies in this range, the majority of the electrons will have lower energies, with the mean energy of the non-equilibrium plasma EED during the pulse typically on the order of 1 to 2 eV making a ladder process the critical dissociation pathway. The electron-molecule scattering cross-section often increases steeply at low energies; thus being able to tailor the EED enables maximizing the dissociation rate. More generally, in various embodiments of the present disclosure the average energy of the plasma over the entire duration of the pulse period may be anywhere in a range from about 0.8 eV to about 100 eV. For instance, according to various embodiments the average energy of the plasma over a given (or the entire) duration of a given pulse period may be in a range from about 0.9 eV to 20 eV, or from 0.9 to 10 eV, or from 1.5 eV to 20 eV, or from 1.5 eV to 10 eV, from about 10 eV to about 20 eV, from about 20 eV to about 30 eV, from greater than 0.9 eV to about 50 eV, or from about 1.5 eV to about 100 eV, etc. as would be understood by a person having ordinary skill in the art upon reading the present disclosure. Moreover, the specific values to which the plasma energy is tuned will depend on the type of process material being utilized, and may be defined according to any known range of values including a known or expected dissociation energy of the type of process material(s) to be dissociated in the reactor.

In the microwave processing systems described above, the microwave energy source is controlled by a microwave emitter circuit (such as 207 in FIGS. 2, and 307 in Figures, that can control the microwave energy emitted from the source to be either continuous wave or pulsed. The microwave emitter circuit can produce microwave energy through the use of a magnetron, such as at 13.56 MHz, 915 MHz, 2.45 GHz, 5.8 GHz, or any value between these stated endpoints. To control the pulse output power of the microwave energy, the microwave emitter circuit may pulse the magnetron at various frequencies and duty cycles. Each microwave emitter circuit is designed for a specific range of pulsing frequency, duty cycle, shape, and pulse output power level, where the selection of specific values of these parameters is used to tune the chemical reaction pathways in the process material. Alternatively, other energy sources may be used to provide energy and ignite the plasma, such as RF sources (e.g., for an output energy on the order of 13.56 MHz).

The microwave control circuit can enable a pulse frequency from 500 Hz to 1000 kHz, or from 1 kHz to 1000 kHz, or from 10 kHz to 1000 kHz, or from 40 kHz to 80 kHz, or from 60 kHz to 70 kHz, or greater than 10 kHz, or greater than 50 kHz, or greater than 100 kHz. The microwave source can emit continuous wave or pulsed microwave energy with a time-average power from 0.5 kW to 100 kW, or from 1 kW to 500 kW, or from 1 kW to 1 MW, or from 10 kW to 5 MW, or greater than 10 kW, or greater than 100 kW, or greater than 500 kW, or greater than 1 MW, or greater than 2 MW. The pulse period has a first duration where the microwave power is on, and a second duration where the microwave energy is off or at a lower power than during the first duration. The second duration can be longer than the first duration. The optimal duty cycle for a given system depends on many factors including the microwave power, pulse frequency, and pulse shape. The duty cycle (such as the fraction of the pulse period where the microwave energy is on, expressed as a percentage) can be from 1% to 99%, or from 1% to 95%, or from 10% to 95%, or from 20% to 80%, or from 50% to 95%, or from 1% to 50%, or from 1% to 40%, or from 1% to 30%, or from 1% to 20%, or from 1% to 10%, or less than 99%, or less than 95%, or less than 80%, or less than 60%, or less than 50%, or less than 40%, or less than 30%, or less than 20%, or less than 10%.

Referring again to FIG. 2, downstream of the diminishing afterglow region 220, reactor 200 includes one or more separation zone(s) (Separation ZoneN) configured to separate various resultants of the dissociation processes and reformation processes that occur upstream thereof in reactor 200. The separation zone(s), for example, may include a gas/solid separator (GSS) configured to separate output gases (e.g., water vapor, molecular oxygen, etc.) from output solids (e.g., solid, elemental forms of the various critical minerals described herein), and direct each to appropriate downstream systems and/or processes. For example, in preferred approaches output gases may be directed to a collection facility or apparatus, for further evaluation and optional processing (e.g., to remove polluting, corrosive, reactive, contaminating, etc. components such as oxides of carbon, nitrogen, sulfur, etc. as known in the art) and/or release (in the case of non-polluting gases such as water vapor and molecular oxygen). However, it should be understood that in most embodiments, as is preferred, refined critical minerals will be collected via collection agents (e.g., salts having absorbed critical minerals) rather than from the gas stream. In most applications, the gas stream is too hot for solid forms of the desired critical minerals (particularly lithium) to form.

In additional implementations, the reactor 200 may include a number of additional or alternative features, including but not limited to various configurations for the waveguide (e.g., having spatial and/or structural configurations tuned to facilitate particular conditions being present in various regions/zones of the reactor 200, especially plasma region 210), gas recycling mechanisms, filaments, electron sources, point sources, electrodes, magnets, etc. as described in greater detail in U.S. Provisional Patent Application No. 63/324,379, filed Mar. 28, 2022 and entitled "METAL REFINEMENT IN A TEMPERATURE-CONTROLLED MATERIAL PROCESSING REACTOR", and/or U.S. Provisional Patent Application No. 63/329,208, filed Apr. 8, 2022 and entitled "TEMPERATURE CONTROLLED MATERIAL PROCESSING REACTOR", the contents of which are herein incorporated by reference in entirety.

In some situations, a particulartemperature can be maintained at throughout a particular zone or combination of zones of the temperature-controlled zone-segregated reactor 200. Moreover, certain reactions are optimally facilitated when a particular temperature (or temperature gradient) is maintained throughout a particular time duration. Accordingly, the zones may be purposely tuned by changing and/or maintaining a particular temperature or temperature gradient over the length of the zone; control of temperature is facilitated by a non-equilibrium plasma, as discussed above. In some cases, and as shown, a particular energy source type is matched with a particular zone so as to create conditions in the particular zone that are most conducive to a desired reaction or process and/or so as to create conditions that inhibit or prevent certain reactions from occurring in the diminishing afterglow region 220.

The conditions in the afterglow can be controlled with different forms of energy input. As one specific example, the afterglow conditions can be controlled with microwave energy. This microwave energy can be directly used to either expand the plasma plume and/or heat the particles in the region. This feature expands the plasma, thereby accommodates tuning of the time the particles spend in the plasma. This feature further facilitates control on the gas phase chemistry, particle charging, and particle heating processes of the particles throughout this region. Control of these parameters lead to control over particle morphology. Alternatively, the energy source in this region can be chosen such that the plasma is not formed and instead the particles arc heated, leading to direct control of the particle temperature. This in turn allows for controlling the growth kinetics and therefore the morphology of the particles.

Further details regarding general approaches to initiating chemical pathways are described in U.S. application Ser. No. 16/751,086 titled "Complex Modality Reactor for Materials Production and Synthesis" filed on Jan. 23, 2020, which is hereby incorporated by reference in its entirety.

As examples, electromagnetic RF inductive and/or electromagnetic capacitive hardware can be configured to provide energy into a particular zone so as to provide joule heat into the diminishing afterglow region 220. Additionally or alternatively, certain intra-reactor conditions (e.g., when operating at lower pressures) can be controlled to provide an energy distribution function to sustain a desired state of the plasma and/or its afterglow so as to reduce the likelihood of recombination of the dissociated species until separation charge potentials can separate species. Further still, certain reactor configurations include intra-and/or extra-reactor hardware (e.g., such as electrodes) for controlling the aforementioned separation charge potentials.

Figure 6:
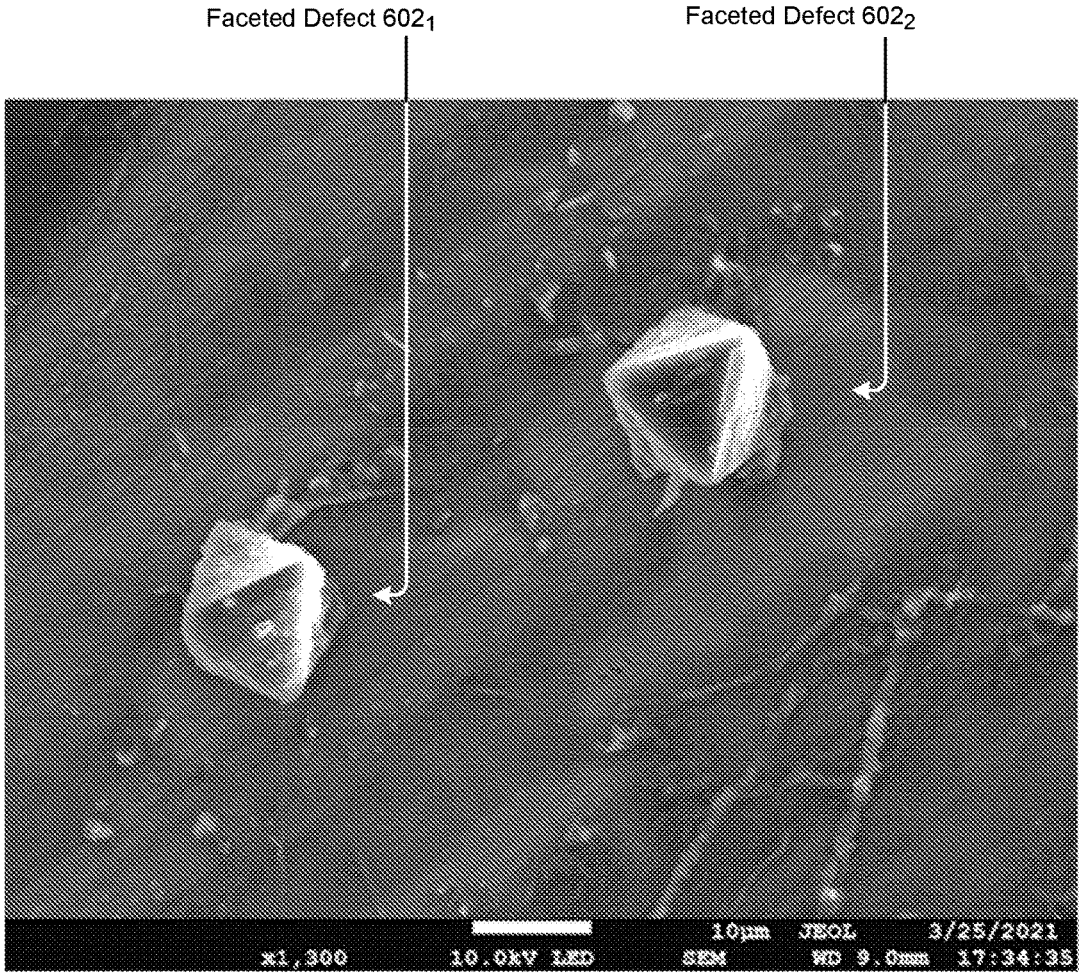
FIG. 6 is a micrograph image of a critical mineral formed according to conventional approaches, and exhibiting a plurality of faceted defects.

The foregoing paragraphs reference merely selected examples of refining a critical mineral-containing compound, e.g., lithium. However, there are many lithium-containing compounds which can be refined into pure lithium metal that is free of impurities and/or crystallographic defects. To illustrate, and to contrast with known in the art techniques, the best-known conventional methods for refining lithium still result in lithium metal in a crystallographic lattice that includes unwanted faceted defects. For example, FIG. 6 is a micrograph image showing faceted defects (e.g., faceted defect 6021, faceted defect 6022) that occur in conventionally refined metals. Through application of the foregoing reactor configurations (e.g., the temperature-controlled zone-segregated reactor 200 of FIG. 2), such faceted defects can be eliminated.

Table 1 lists additional lithium-containing compounds that can be refined into pure lithium. Table 2 lists exemplary non-lithium-containing compounds that can be similarly refined.

TABLE 1

Exemplary Lithium-Based, Critical Mineral-Containing Compounds

| Input Compound | Objective Resultant |
|---|---|
| LiOH | Pure lithium metal |
| LiCl | Pure lithium metal |
| $LiO_2$ | Pure lithium metal |
| $Li_2CO_3$ | Pure lithium metal |

TABLE 2

Exemplary Non-Lithium, Critical Mineral-Containing Compounds

| Input Compound | Objective Resultant |
|---|---|
| NaOH | Pure sodium powder |
| NaCl | Pure sodium powder |
| NaBr | Pure sodium powder |
| $Na_2CO_3$ | Pure sodium powder |
| $MgCl_2$ | Pure magnesium metal |
| MgOH | Pure magnesium metal |
| $CaCl_2$ | Pure calcium powder |
| $CaCO_3$ | Pure calcium powder |

As those skilled in the art can now appreciate, through use of the foregoing direct extraction techniques and/or through use of selected adsorption agents in the reaction chamber(s) the refined materials exhibit substantially perfect crystallographic morphologies. More specifically, through use of the foregoing direct extraction techniques and/or through use of particularly selected adsorption agents in the reaction chamber, faceted defects that are found in conventionally-refined material can be eliminated.

Example #1: Controlling Recombination Using Selected Adsorption Agents (or "Getter Materials")

Refinement of lithium using a plasma reactor that is configured to support single stage or multiple stage refinement processes can reduce processing time as well as attendant monetary costs involved in achieving extremely high purity lithium. As is known by those of skill in the art, a microwave plasma reactor can separate (e.g., dissociate) compound materials into the material's elemental constituents. Such separation can be induced through use of thermal means (e.g., in an equilibrium plasma) or can be induced by charged particle impact dissociation or by use of a ladder-type vibrational excitation process in a non-equilibrium diffuse plasma. Unfortunately, after lithium compounds such as lithium chloride, lithium hydroxide, or lithium carbonate are dissociated (e.g., using the herein-disclosed plasma processing techniques), the dissociated lithium readily recombines with various other elements whenever and wherever conditions support such recombination. As such, so as to control conditions inside the reactor, certain adsorption agents or materials or chemistries may be introduced into the reactor (e.g., so as to prevent the aforementioned unwanted recombination from occurring). Such adsorption agents are also referred to herein as "getter materials", "getter agents", etc.

An adsorption agent for scavenging the elements bound to the lithium in the raw input material can be selected from any material that does not alloy with lithium and has a low solid solubility for lithium. For example, tantalum is an excellent choice for an adsorption agent, since (1) it forms a chloride, oxides, hydroxides, and carbonates, (2) does not alloy with lithium and (3) has a very low solid solubility with lithium, especially at low temperatures. Tungsten is another candidate material. Still other materials such as iron phosphate, silicon, activated carbon, nickel monoxide, or combinations thereof can be used as an adsorption agents, especially for lithium.

Example #2: Simultaneous Creation of Highly Pure Lithium and a Solid Electrolyte It is known that lithium can dissolve in phosphates. Further, it is known that lithium-based phosphates can be advantageously used as solid electrolytes in batteries. Specifically, and strictly as an example, lithium phosphorous oxynitride can be used as the solid electrolyte in solid state lithium batteries. As another example, a lithium loaded phosphate can be used as a solid electrolyte. As such it should be noted that, during refinement (e.g., inside the reactor), the separation process will simultaneously create (1) highly pure lithium and (2) a solid electrolyte. This simultaneous creation of (1) highly pure lithium (as used in certain types of batteries) and (2) a solid electrolyte (as used in the same types of batteries) inures to enhanced economic benefits when using the aforementioned processes to produce materials for batteries.

Example #3: Refined Lithium from Lithium Chloride

Continuing to provide example lithium refining scenarios, refined lithium can derive from lithium chloride. In this particular scenario, introducing a tantalum-containing selective adsorption agent into the reactor will result in formation of tantalum chloride, $TaCl_5$, which has a very low melting point (about 216° C.). Having the tantalum-containing selective adsorption agent in the plasma zone of a thermal microwave plasma (or in an inductively coupled plasma, or in a capacitively coupled plasma) results in melting/evaporation of any TaCls formed. For other starting materials such as lithium hydroxide or carbonate, the high temperatures (e.g., several thousand degrees Kelvin) of thermal microwave plasmas, will advantageously result in significant evaporation of adsorbed oxygen, carbon, or hydrogen. In the case of refinement with a lithium chloride starting material, either (1) the selective adsorption agent or (2) metallic plates can be charged to attract the positive lithium ions and negative chlorine ions, thus increasing the rate of adsorption. Still further, non-equilibrium microwave plasmas exhibit both (1) a high charged particle density and (2) low temperatures. These are conditions that facilitate plasma-based refinement of high-purity lithium.

Example #4: Intra-Reactor Pressure Control

In some example situations, plasma refinement of lithium is carried out in a high vacuum environment so as to reduce or eliminate the presence of reactive residual gas species such as steam, oxygen, nitrogen, and carbon dioxide. Use of certain selective adsorption agents may allow for processing at up to atmospheric pressures as such certain selective adsorption agents continue to strongly adsorb any residual gases even as the intra-reactor pressure increases.

Example #5: Using a Porous Adsorption Agent

A porous selective adsorption agent with a high surface area (e.g., possibly formed using twin-wire arc or via plasma spraying) can adsorb especially high quantities of desired material. Preferred configurations and components for utilizing adsorption agent(s) are discussed in greater detail hereinbelow with reference to FIGS. 3A-3F, and may enable continuous (or substantially continuous) operation of a reactor such as reactor 200. For instance, employing the presently described inventive concepts allows use of adsorption agents to facilitate separation and capture of various species of material without requiring any interruption of reactor operation beyond that normally required for maintenance of a reactor not configured to utilize adsorption agents.

Example #6: Passivation of High Purity Lithium

In some cases, adsorbed lithium can be passivated with hydrogen, which passivated materials then can be removed from the plasma containment vessel without contamination (e.g., from the ambient environment). In some cases, constituents of the aforementioned non-equilibrium plasmas (e.g., elemental hydrogen) may be used to facilitate passivation of the high purity lithium while inside the plasma containment vessel (e.g., since elemental hydrogen can be produced inside the reactor). Such techniques, in certain embodiments, may involve using a separate plasma, such as an argon-hydrogen plasma, for passivation.

Getter Cartridge and Continuous Reactor Operation

Non-equilibrium microwave plasmas have both high charged particle density and low temperatures, making them a promising candidate for plasma refinement of lithium or other critical minerals. However, even if lithium compounds such as lithium chloride, lithium hydroxide, or lithium carbonate are dissociated via plasma processing, lithium will readily recombine with the other elements once it exits the microwave zone. The same is true for non-lithium critical minerals of interest. Accordingly, the presently described inventive concepts include, according to some aspects, use of a selective getter material or chemistry to prevent undesired recombination of dissociated species from occurring in the afterglow region of thermal plasmas or in the plasma region of a cool non-equilibrium plasma, conveying significant advantages to aqueous mining and refinement of such minerals.

For example, one common aspect of plasma refinement of lithium is high vacuum processing to limit presence of reactive residual gas species such as water, oxygen, nitrogen, and carbon dioxide. As one advantage, use of a selective getter may allow for processing at up to atmospheric pressures as it will strongly getter any residual gases.

Further still, passivating gettered materials, particularly reactive metals such as lithium, magnesium, sodium, etc., with hydrogen or other suitable passivating agent facilitates removal thereof from the plasma system without contamination in room air. A non-equilibrium plasma, according to certain aspects, facilitates passivation of such metals as the plasma can create atomic hydrogen, while allowing for maintaining the temperature of the adsorption agents below that at which desorption or dissociation, in the case of compound formation with the adsorption agent, of the gettered material will occur.

As noted above regarding Example #5, certain aspects of the presently described inventive concepts include the use of one or more materials generally characterized as "getters" or "getter materials". In the context of the present disclosure, a "getter" or "getter material" shall be understood as a compound, material, mixture, etc. that reacts chemically, or by adsorption, with one or more species produced in a dissociating reactor during operation thereof for aqueous mining of critical minerals. According to various embodiments, getters may thus be characterized as adsorption agents; or as "trapping agents" (where the getter material is highly reactive with one or more species present during dissociation and/or reformation processes taking place within reactor 200, i.e., where the getter material is chemically configured to react with said one or more species. This can occur by the following mechanisms, according to various embodiments: forming a thin compound upon which pure critical mineral can grow, forming a compound that is easily separable from desired species of critical minerals, e.g., using a gas-solid separator or other equivalent thereof), or dissolution of the critical mineral into the getter to form a useful end product such as a solid electrolyte.

Regardless of the particular mechanism by which getters operate, skilled artisans will appreciate that the materials are especially useful for removing undesired species from the reactor environment, facilitating formation and collection of desired critical minerals from the reactor 200. More preferably, getters are suitable to adsorb and/or reversibly react with desired species of critical minerals and thus further facilitate collection thereof from the reactor.

According to various embodiments, any material that does not alloy lithium and has low solid solubility is a suitable candidate. For example, tantalum is an excellent choice for a selective getter, as it forms salts in the form of halides, oxides, hydroxides, and carbonates, but does not alloy with lithium and has a very low solid solubility with lithium, especially at low temperatures. Tungsten is another promising candidate material. Another material such as iron phosphate can be used as a getter, particularly for refinement of lithium. Still further materials such as silicon, nickel monoxide, zeolites, metal foams, and activated carbon are suitable for use as getter materials according to various embodiments. Of course, combinations of such getters, and/or equivalents thereof that would be appreciated as suitable for mineral refinement by those having ordinary skill in the art upon reading the present disclosure may additionally or alternatively be employed without departing from the scope of the inventive concepts presented herein.

For refinement of lithium from lithium chloride, a common starting material, a tantalum getter will form tantalum chloride, $TaCl_5$, which has a very low melting point of 216° C. Therefore, having the getter in the plasma zone of a thermal microwave or even inductively coupled or capacitively coupled plasma will result in melting/evaporation of any $TaCl_5$ formed. Even for other starting materials such as lithium hydroxide or carbonate, the high temperatures of thermal microwave plasmas, several thousand Kelvin, will result in significant evaporation of gettered oxygen, carbon, and/or hydrogen.

Additionally or alternatively, in some embodiments charged regions or plates can be used to attract the positive metal ions and negative (generally non-metal) ions that dissociate from the input (preferably salt) material, increasing the getter rate.

In other implementations, where the desired critical mineral is or includes sodium, and is to be refined from salts such as sodium hydroxide, sodium chloride, sodium carbonate, etc. as described herein, preferred getter materials include or are selected from: tantalum, tungsten, iron phosphate, silicon, nickel monoxide, activated carbon one or more zeolites, metal foams, and combinations thereof, and/or suitable equivalents that would be appreciated by a skilled artisan upon reading the instant disclosure.

In more aspects, where the desired critical mineral is or includes calcium, and is to be refined from salts such as calcium hydroxide, calcium chloride, calcium carbonate, etc. as described herein, preferred getter materials include or are selected from: tantalum, tungsten, iron phosphate, silicon, nickel monoxide, activated carbon, one or more zeolites, metal foams, and combinations thereof, and/or suitable equivalents that would be appreciated by a skilled artisan upon reading the instant disclosure.

Further, where the desired critical mineral is or includes magnesium, and is to be refined from salts such as magnesium hydroxide, magnesium chloride, magnesium oxide, magnesium carbonate, etc. as described herein, preferred getter materials include or are selected from: tantalum, tungsten, iron phosphate, silicon, nickel monoxide, activated carbon, one or more zeolites, metal foams and combinations thereof, and/or suitable equivalents that would be appreciated by a skilled artisan upon reading the instant disclosure.

Further still, where the desired critical mineral is or includes carbon, preferred getter materials include or are selected from: tantalum, tungsten, iron phosphate, silicon, nickel monoxide, activated carbon, one or more zeolites, metal foams, and combinations thereof, and/or suitable equivalents that would be appreciated by a skilled artisan upon reading the instant disclosure. However, advantageously, some solid carbon is likely to form and be collected via a gas-solid separator (or other suitable equivalent thereof), which may be positioned near the bottom of the reactor to facilitate said collection.

To improve gettering action, the getter may be deposited on or otherwise disposed in pores and/or surfaces of a highly porous substrate having a plurality of fluidically interconnected channels. Such a porous selective getter with a high surface area, e.g., as may be formed using twin-wire arc or plasma spraying, will improve functionality of the getter material(s). According to various implementations, suitable substrate materials include, without limitation, tantalum, tungsten, iron phosphate, silicon, nickel monoxide, activated carbon, etc. Porous embodiments of the aforementioned getter materials may be utilized as well, in different approaches. For example, additional embodiments may be provided in the form of metal foams, or sprayed materials.

While leveraging gettering improves extraction and refinement of desired critical minerals from input material (e.g., various salts as described herein), over time the getter materials are consumed (in the case of chemical reactions) or lose gettering capability (e.g., where surface(s) of an adsorption agent are increasingly covered by adsorbing species, and lose ability to further "capture" such species from the reactor environment or become so thickly coating with the critical mineral or other salt by-product that adhesion becomes an issue). Accordingly, to maintain desired functionality, the getter materials must be replaced periodically. This getter upkeep requirement may require periodic shut-down of the reactor, negatively impacting energy production, mineral refinement, and/or other associated reactor functions.

Accordingly, yet another aspect of the presently described inventive concepts facilitates continuous, or substantially continuous, operation of the reactor in combination with advantages conveyed by getters. As understood herein, continuous, or substantially continuous, operation of a reactor means that the upkeep and maintenance associated with using a getter or getters does not contribute to reactor down-time. Instead, the getter(s) (and, in some instances, chemical products of reaction with undesired species, and/or adsorbed species) may be removed and replaced in a seamless manner, avoiding undesirable interruption of the reactor.

According to preferred embodiments, continuous or substantially continuous operation of a reactor while using getter(s) to improve refinement of critical minerals may be achieved, at least in part, using a cartridge and reactor body configured substantially as shown in FIGS. 3A-3D. While FIGS. 3A-3D depict one suitable configuration, those having ordinary skill in the art will appreciate, upon reading these descriptions, that other functionally equivalent configurations may be employed without departing from the scope of the present disclosure. For instance, different shapes, cross sectional profiles, and/or arrangements of the various components depicted in FIGS. 3A-3F may be employed without departing from the scope of the invention described herein.

Figure 3A:
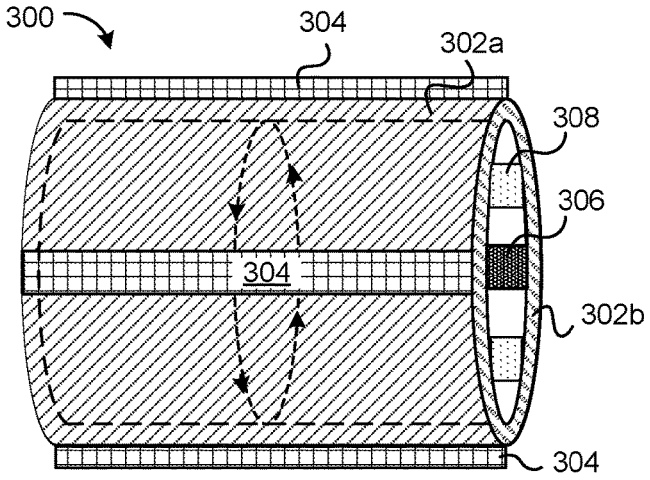
FIG. 3A depicts a side-view schematic of a getter cartridge designed to interface with a reactor body, according to one configuration.

Referring now to FIG. 3A, a simplified schematic of a getter cartridge 300 is shown, according to one implementation and from a side view perspective. The getter cartridge 300 includes a cylindrical body having an outer portion 302*a* and an inner portion 302*b*. As indicated by the dotted line arrows, the inner portion 302*b* of the body is preferably rotatable about a central axis of the cylinder. At various positions, preferably spaced at regular intervals, a plurality of rails 304 (alternatively, fasteners, hooks, bolts, holes, slots, clamps, or any other suitable equivalent components for engaging a corresponding component on the reactor body 310) are positioned along the outer portion 302*a* of the cartridge body. Moreover, as shown in FIG. 3C and according to one implementation rails 304 are configured to physically engage a plurality of slots 312 of the reactor body 310, securing the getter cartridge 300 within the reactor body 310. In more embodiments, the slots 312 may additionally or alternatively include fasteners, hooks, bolts, holes, slots, clamps, or any other suitable equivalent components for engaging a corresponding component on the getter cartridge 300.

Along the interior surface of the cartridge body's inner portion 302*b* are a plurality of first and second getter material regions 306, 308. Each getter material region 306, 308 preferably includes a porous substrate and at least one getter material disposed in or on pores and/or surfaces of the substrate. More preferably, first getter material regions 306 include a getter configured (e.g., chemically or physically, such as via adsorption) to "collect" desired species, such as elemental forms of critical minerals. Similarly, second getter material regions 308 are preferably configured (again, chemically or physically) to "collect" undesired species, such as non-metal components of input salt materials, oxygen, water, etc. as described herein and as would be appreciated by a person having ordinary skill in the art upon reading the present disclosure.

Each of the first getter material regions 306 and second getter material regions are preferably formed in and/or on the inner surface of inner region 302*b* of getter cartridges 300. For instance, again as depicted in FIGS. 3A-3D, substantially rectangular stripes may be formed from suitable substrate and associated getter material(s) along the inner surface of inner region 302*b*. These stripes may be positioned around the inner circumference of inner region 302*b*, and oriented such that the principal axis of the getter material regions aligns with (e.g., is parallel to) the principal axis of the cylindrical body of cartridge 300. However, in other embodiments, similar stripes may be formed along, and substantially parallel to a cross sectional plane of the cylindrical body of the cartridge 300. The getter material regions may also be positioned substantially adjacent to one another with gaps therebetween, as shown in FIGS. 3A-3D, although other implementations may not leave any gap(s) between adjacent getter material regions.

Forming getter material regions may include plasma spraying the substrate and/or getter materials, forming a substrate within the inner region 302*b* using a twin-wire arc, depositing a suitable substrate to the inner surface of inner region 302*b* and embedding (according to any suitable mechanism) getter material(s) in or with the substrate, or any other suitable technique as would be appreciated by persons having ordinary skill in the art upon reading the instant disclosure. For instance, in some implementations the getter material regions may be embodied in the form of a plurality of prefabricated, removable filters including getter material embedded in pores and/or disposed on surface(s) of a porous substrate.

While the exemplary implementation depicted in FIGS. 3A-3D includes four rails 304 positioned at approximately 90-degree intervals around the outer portion 302*a* of the getter cartridge 300, skilled artisans will appreciate that according to other implementations, different numbers and/or positioning may be employed without departing from the scope of the presently described inventive concepts. So long as the number and spatial configuration of the rails 304 is suitably configured to engage with corresponding slots 312 of a reactor body 310, and securely hold the cartridge within the reactor body 310 during operation thereof, rails 304 are consistent with the inventive concepts presented herein.

Similarly, although the exemplary configuration depicted in FIGS. 3A-3D includes four first gettering regions 306 and four second gettering regions 308, positioned substantially equally distributed along the inner circumference of inner surface 302*b*, other types, numbers, and/or spatial configurations may be employed without departing from the scope of the inventive concepts set forth in this description. For instance, fewer or additional getter material regions including different or additional getter materials than present in first getter material regions 306 and/or second getter material regions 308 may be employed. Similarly, although the getter material regions 306, 308 as shown in FIGS. 3A-3D are provided essentially in the form of rectangular "stripes" formed in or on the inner surface 302*b* of the getter cartridge 300, different shapes, distributions, patterns, etc. may be implemented in forming suitable getter material regions according to various embodiments.

Figure 3B:
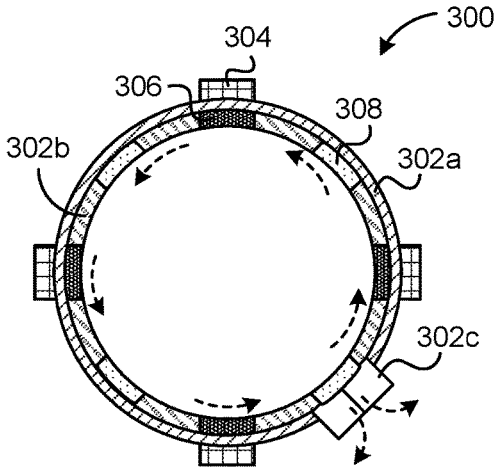
FIG. 3B depicts a top-view schematic of the getter cartridge shown in FIG. 3A, according to one embodiment.
Figure 3C:
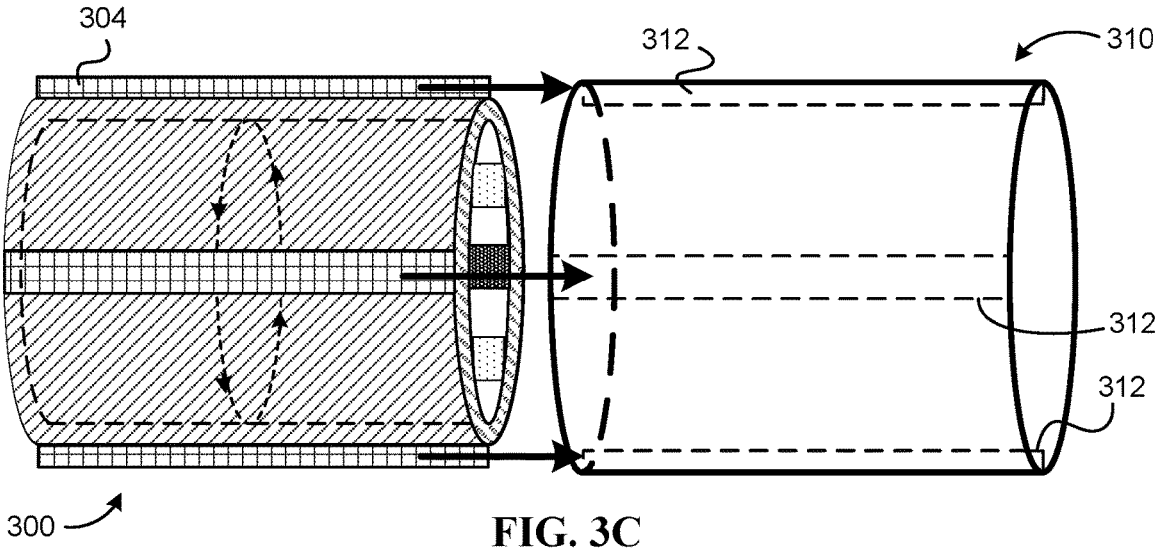
FIG. 3C depicts a side-view schematic of the getter cartridge shown in FIG. 3A, interfacing with a reactor body according to one aspect.

Referring now to FIG. 3B, which depicts a top-view schematic of the getter cartridge shown in FIG. 3A, according to one embodiment, it can be seen that the cartridge 300 also preferably, but optionally, includes a getter access mechanism 302*c*, such as a door, sliding panel, removable window, or any other suitable configuration that would be understood by a person having ordinary skill in the art upon reading the present disclosure. The getter access mechanism 302*c* is formed in the cartridge body, and provides access to the inner region 302*b* of the cartridge 300. For instance, the inner region 302*b* (again as indicated by dashed arrows) is rotatably mounted within the cartridge 300, and via such rotation a given getter material region may be positioned adjacent the getter access mechanism. The getter access mechanism may be activated (e.g., by opening the doors, sliding the panel, removing the window, etc.) to provide direct access to the adjacent getter material region. Importantly, getter access mechanism 302*c*, in combination with the rotatable action of inner region 302*b*, provides access to all getter material regions of the getter cartridge 300. According to some embodiments, access may be provided without needing to "open" the reactor, although the reactor would need to be in an "off" operational state during access. Furthermore, though not shown in FIGS. 3A-3D, access may be facilitated by a specialized tool designed for compatibility with the spatial configuration of the getter cartridge 300, particularly getter access mechanism 302*c*, as well as the configuration of the reactor using the getter cartridge 300. The specialized tool may be used to collect spent getter material, and/or to provide new or additional getter material to the getter cartridge 300, upon which the reactor may be returned to normal operation.

In particularly preferred approaches, the getter cartridge 300 is configured so that the amount and disposition of getter material is sufficient to effectively last over the entire duration of a "normal" operational period of the reactor in which the getter cartridge 300 is to be used. For instance, preferably the getter cartridge 300 is sufficiently large, porous, etc. to contain sufficient getter material to effectively perform as described herein with respect to "capture" of desired and/or undesired species within the operating reactor environment, for an amount of time at least as long as a typical duration between normally-scheduled reactor maintenance (i.e., maintenance required even when operating the reactor without use of a getter cartridge 300). In other terms, the duty cycle of the reactor is synchronized with the operational period for the getter cartridge.

According to certain examples suitable getter materials include zeolites, which can have a specific surface area (SSA) from 50 to >1000 $m^2/g$, and/or metal foams, which can have SSA up to 5 $m^2/g$. Similarly, sprayed coatings can exhibit a SSA in a range from about 50 $m^2/g$ to about 120 $m^2/g$, and may be employed according to various embodiments. Accordingly, preferred getter materials, in addition to other characteristics described herein (such as high melting temperature, corrosion resistance, etc.) may be characterized by having a specific surface area of at least 5 $m^2/g$, at least about 50 $m^2/g$, at least about 100 $m^2/g$, or at least about 1000 $m^2/g$, in various approaches. Alternatively, the specific surface area of suitable getter materials may be in a range from about 5 $m^2/g$ to about 1200 $m^2/g$, in a range from about 10 $m^2/g$ to about 1000 $m^2/g$, in a range from about 50 $m^2/g$ to about 1000 $m^2/g$, in a range from about 50 $m^2/g$ to about 100 $m^2/g$, or any range defined by these endpoints, or other endpoints, generally within the span of about 1 $m^2/g$ to about 1500 $m^2/g$, according to various embodiments. According to several specific examples, an activated carbon getter material may be characterized by a specific surface area in a range from about 1000 $m^2/g$ to about 1500 $m^2/g$. A porous silicon getter material may be characterized by a specific surface area in a range from about 300 $m^2/g$ to about 580 $m^2/g$.

FIG. 3C depicts a side-view schematic of the getter cartridge 300 as shown in FIGS. 3A and 3B, engaging a reactor body 310, according to one aspect. According to the implementation shown in FIG. 3C, rails 304 of the getter cartridge 300 are aligned with corresponding slots 312 of the reactor body 310. The getter cartridge 300 is inserted into the reactor body 310, and held in place via the rails 304 and slots 312. As can be appreciated from viewing FIGS. 3C and 3D, the inner region 302*b* of getter cartridge 300 remains rotatably movable even upon engagement of the getter cartridge 300 with the reactor body 310. However, the getter cartridge 300 as a whole is secured in place via the slots 304 and rails 312.

Moreover, although not shown in FIG. 3C, clamps or other suitable components for securing the rails within the slots (e.g., to prevent horizontal movement according to the orientation shown in FIG. 3C) may be employed. Such components may be included as part of the rails 304, part of the slots 312, part of the reactor body 310, or functionally coupled to any one or more of these elements, according to various embodiments. Finally, note the rearmost rail is omitted from FIG. 3C for simplicity, but is to be understood as present in the actual embodiment represented by FIG. 3C.

Figure 3D:
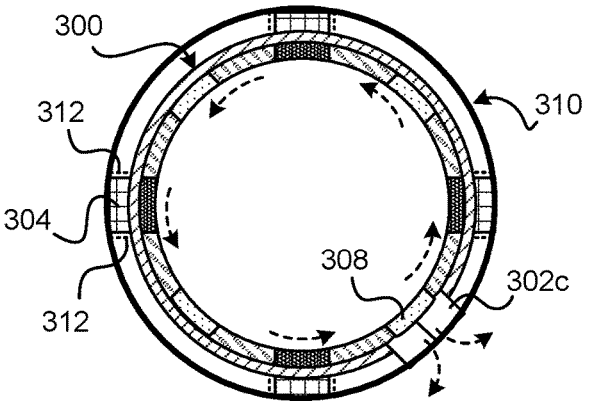
FIG. 3D is a top-view schematic of a getter cartridge engaged with a reactor body, according to one implementation.

Turning now to FIG. 3D, a top-view schematic of a getter cartridge 300 engaged with a reactor body 310 is shown, according to one implementation. Again, this configuration advantageously allows direct access to getter materials in first and second getter material regions 306, 308 (as well as any other getter material regions that may be present in myriad configurations), without requiring the reactor body 310 be "opened". As shown in FIG. 3D, the inner region 302*b* is rotated within the getter cartridge 300 such that the lower right (second) getter material region 308 is positioned adjacent to an inner surface of getter access mechanism 302*c*. As indicated by the outward-pointing dashed arrows, getter access mechanism is activated (e.g., by opening doors, sliding panels, removing windows, etc.) to provide access to the getter material (and any "captured" species, in some embodiments) and facilitate removal and/or replacement thereof (either with the same substrate and/or getter, different substrate and/or getter, or additional substrate and/or getter (where additional getter material may include the same type as just removed, and/or different getter materials)). Access to different getter material regions 306, 308 may be provided by rotating inner region 302*b* such that the desired getter material region is appropriately positioned near the inner surface, aperture, etc. of getter access mechanism 302*c*.

As will be appreciated by those having ordinary skill in the art upon reading the disclosure set forth herein, in various embodiments all of the getter material regions 306, 308 may be exposed to the reactor environment during operation thereof, or only a subset of such getter material regions may be so exposed, while others are "protected" to prevent consumption of the getter material in the protected getter material region(s). Protection may be achieved using any suitable configuration or technique, and in one approach includes covering or blocking exposed portions of select getter material region(s), e.g., with a layer or plate of suitable material that prevents species in the operating reactor from accessing (physically, chemically, or otherwise) the selected getter material region(s). While exposing all getter material regions present in the getter cartridge may provide maximum gettering action (and thus refinement efficiency), selectively exposing only certain getter material regions over time may extend the operational lifetime of the getter cartridge 300 as a whole while still providing sufficient gettering action. The latter case may facilitate continuous, or substantially continuous, operation of the reactor while leveraging the advantageous aspects associated with gettering, in various approaches.

In addition to the foregoing, according to certain approaches it may be advantageous to arrange the location of various getter materials/getter material regions to facilitate selective and efficient collection of particular materials at various points throughout the reactor. For instance, where dissociation of various input species produces compounds that are likely to interact in undesired chemical pathways, and/or recombine with other species forming undesirable intermediates and/or products, it may be advantageous to place getter material regions having materials that are particularly adept, and/or configured, to adsorb, react with, or otherwise "trap" the undesirable compounds, reducing or eliminating the occurrence of undesired chemical pathways and/or undesired species within the reactor. In particular, where input materials include chlorine and/or oxygen, it may be advantageous to place getter material regions having getter materials suitable for adsorbing, collecting, reacting with, or otherwise "trapping" chlorine and/or oxygen at a position upstream (i.e., closer to the location where such materials were input into the reactor) of other getter material regions having getter materials particularly adept and/or configured to adsorb desired species, preferably including species of refined critical mineral(s) (or suitable precursors, such as salts, thereof).

Figure 3E:
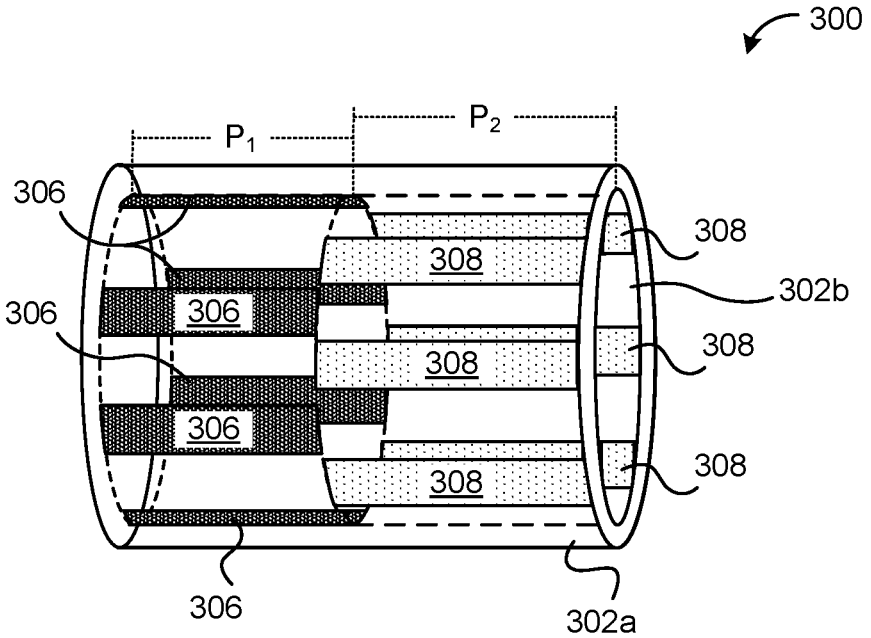
FIG. 3E a side-view schematic of a getter cartridge having getter materials placed in different regions of the cartridge for improved collection, according to one configuration.

Accordingly, FIG. 3E depicts an exemplary embodiment where getter material regions 306 and 308 are positioned along different portions $P_1$, $P_2$ of the cartridge 300. According to the foregoing example, getter material regions 306 include one or more getter materials particularly adept or otherwise configured to preferentially and/or selectively react with, adsorb, collect, or otherwise "trap" undesired species of dissociated input materials and/or compounds that tend to participate in unwanted chemical reactions and/or recombine into undesired species under conditions present in the reactor, particularly within region $P_1$. As such, region $P_1$ is preferably upstream of region $P_2$, and is correspondingly closer to the location (e.g., one of the flow inlets 2181, 2182, or 2183, more preferably either flow inlet 2181 or 2182,) where corresponding input materials are provided to the reactor environment. Continuing with the foregoing example, getter material regions 308 preferably include one or more getter materials particularly adept at, or otherwise configured to, preferentially and/or selectively react with, adsorb, collect, or otherwise "trap" desired species, most preferably including but not necessarily limited to refined critical minerals, and/or derivatives (such as salts) thereof.

While the illustrative implementation depicted in FIG. 3E shows different regions $P_1$, $P_2$ arranged substantially along the length of cartridge 300, it should be understood that different arrangements (e.g., where adjacent regions may partially or wholly overlap, where regions do not necessarily encompass the entire inner surface 302*b* of the cartridge, etc. as would be appreciated by a person having ordinary skill in the art upon reading the present disclosure) and/or numbers of regions (e.g., 3, 4, 5, 10, 20, or any number practically capable of being placed in or along the inner surface 302*b* of the cartridge 300) may be utilized without departing from the scope of the inventive concepts presented herein.

Similarly, getter material regions 306, 308 may be configured in any suitable shape, form, arrangement, etc. according to different approaches without departing from the scope of the present disclosure. For example, getter material regions 306 and/or 308 may be aligned in a series of "rings"

within a given region, according to a predefined pattern (such as a cross-hatched pattern, a polka-dotted pattern, as a series of parallel or concentric lines, such as diagonal lines, serpentine curves, zig-zag lines, etc. as would be understood by a person having ordinary skill in the art upon reviewing the inventive concepts described herein), or any other suitable equivalent thereof that would be appreciated by skilled artisans apprised of the text and figures provided in this application.

Figure 3F:
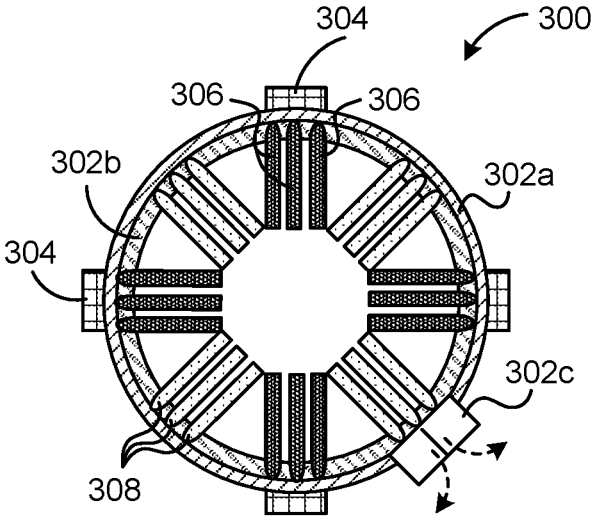
FIG. 3F a top-view schematic of the getter cartridge shown in FIG. 3A, where getter materials are configured in arrays that extend from the outer diameter of the cartridge toward a central axis of the cartridge, according to one embodiment.

Turning now to FIG. 3F, a getter cartridge 300 having getter material regions 306, 308 configured or arranged as a plurality of arrays disposed along an interior volume of the cartridge 300 is shown from, a top-down view, and according to one embodiment. As shown in FIG. 3F, the getter cartridge 300 includes all components substantially as shown and arranged in FIG. 3B, except that getter material regions 306, 308, are arranged as an alternating series of arrays each including a plurality of getter material regions 306, 308 extending radially inward from the inner surface 302*b* toward the central region of the cartridge 300. Advantageously, such configurations increase the surface area of getter materials that are exposed to various dissociated species, compounds, etc. present in the reactor during operation thereof (especially during refinement of critical minerals). Accordingly, improved reaction or interaction between the getter materials in getter material regions 306, 308 may improve the removal of undesired species, prevent or mitigate unwanted chemical reactions, and/or facilitate conversion of input materials into desired species of critical, refined minerals.

In addition, employing configurations where getter material regions occupy relatively larger volume within the interior of the reactor may improve efficiency and/or total yield of critically refined minerals, and/or allow less intensive operational conditions, such as lower plasma energy, frequency, electric field strength, etc. as would be understood by a person having ordinary skill in the art upon reading the present disclosure. Accordingly, the arrangement shown in FIG. 3F should be considered a preferred implementation of getter cartridge 300.

However, variations on the arrangement shown in FIG. 3F should be understood as within the scope of the inventive concepts presently described. For example, different numbers of "spokes" may be included in each array of getter material regions 306, 308. Any number of "spokes" may be included, preferably any number in a range from one to ten spokes per array. Similarly, the number and/or arrangement of arrays may vary without departing from the scope of the present disclosure. In different approaches, arrays each including a single spoke of either getter material region 306 or getter material region 308 may alternate around the inner surface 302*b* of the getter cartridge 300. Different spokes within a given array, or across arrays, may comprise different physical arrangements, even where comprising the same or similar materials. For instance, certain spokes may be structurally characterized as a foam, may have characteristics of being formed via spraying, etching, etc., may have a substantially fractal geometry or shape, may be arranged according to one or more predefined patterns, etc. as would be understood by a person having ordinary skill in the art upon reading the present disclosure.

It will be apparent from the foregoing descriptions, especially regarding FIGS. 3A-3F, that the getter cartridge 300 may be implemented with various features, configurations, components, and/or compositions described herein. These features, configurations, components, and/or compositions are to be considered modular in nature, and may be employed in any suitable combination, permutation, etc., unless otherwise expressly stated herein, without departing from the scope of the presently disclosed inventive concepts.

Methods for Refining Critical Minerals Using a Dissociative Reactor

Figure 4:
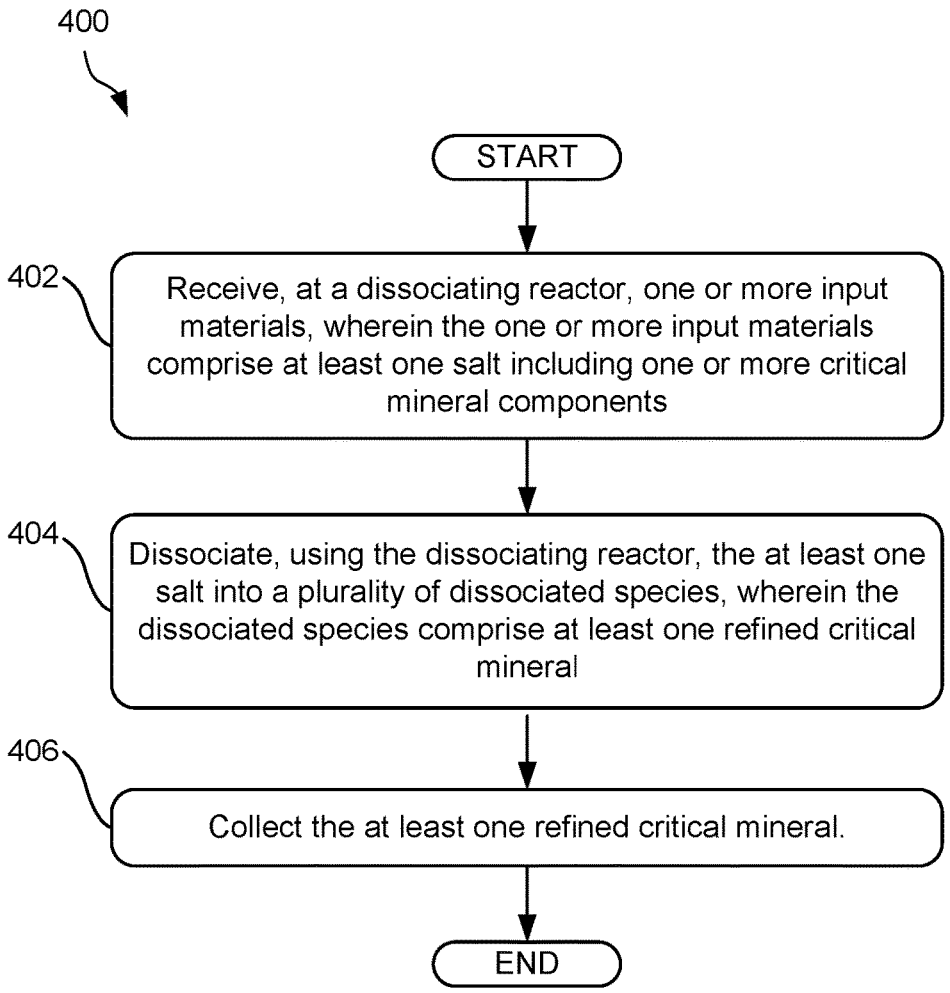
FIG. 4 is a flowchart of a method for refining critical minerals obtained via aqueous mining, using a dissociating reactor, according to one approach.
Figure 5:
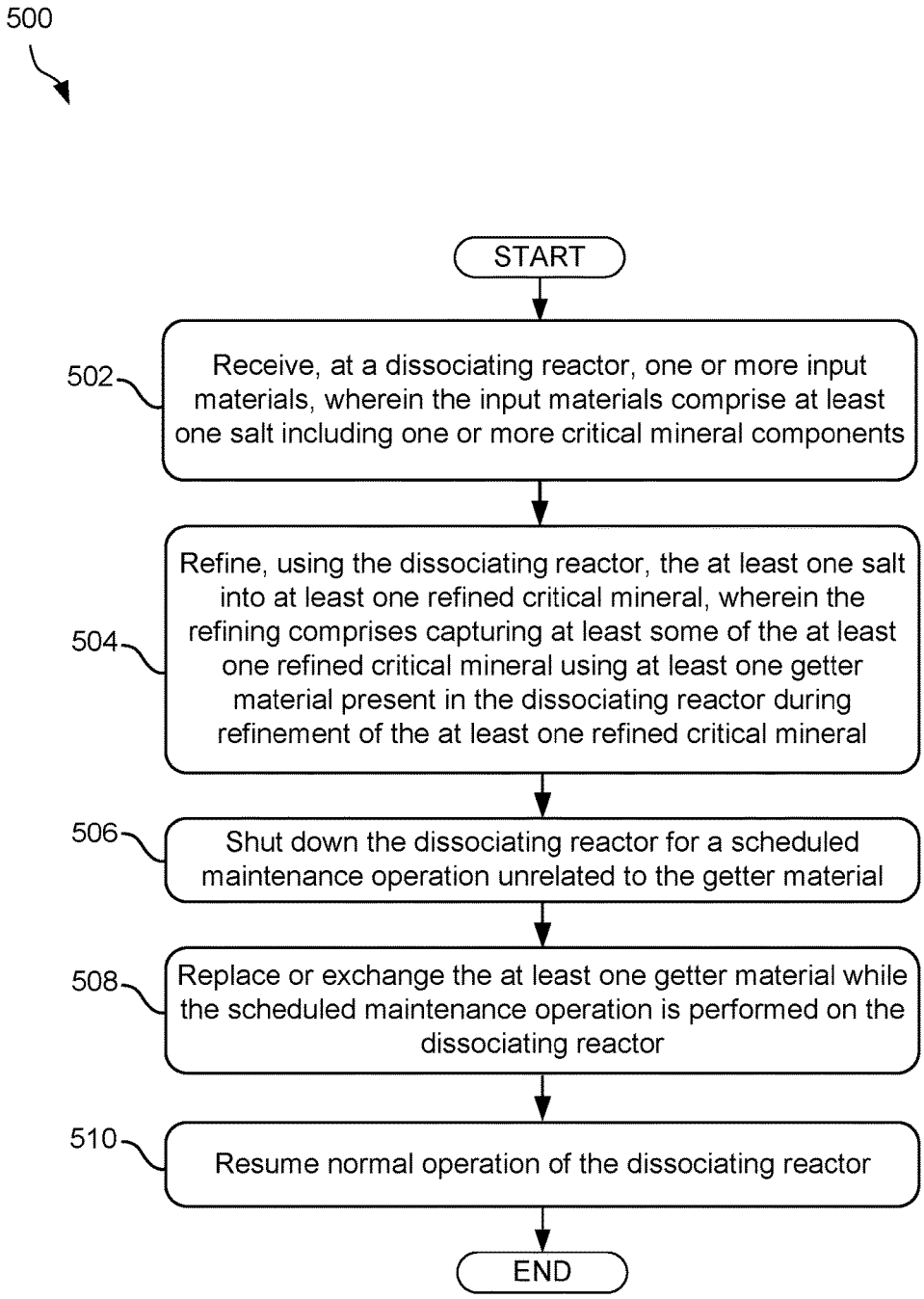
FIG. 5 is a flowchart of a method for refining critical minerals obtained via aqueous mining, using a dissociating reactor, according to another approach.

Turning now to techniques for using the hereinabove described systems and apparatuses for refinement of critical minerals, and particularly critical minerals present in input materials obtained via aqueous mining techniques, FIG. 4 depicts a flowchart of one such suitable method 400, according to one implementation. It shall be understood that method 400 may be performed in any suitable environment and/or using any suitable apparatus, including but not limited to those shown in FIGS. 1-3D and corresponding descriptions thereof. Moreover, unless expressly stated otherwise, method 400 may be performed in combination with one or more operations of other method(s) set forth herein, including but not limited to method 500 as shown in FIG. 5 and described in greater detail below.

Referring again to FIG. 4, in operation 402, method 400 includes receiving, at the dissociating reactor, one or more input materials, wherein the one or more input materials. The input materials comprise at least one salt including one or more critical mineral components, e.g., metal components of one or more salts such as halides, oxides, hydroxides, carbonates, etc. in various embodiments. Preferably, the salts are salts are salts of lithium, sodium, calcium, magnesium, copper, or other ionic conductors, according to various embodiments. Specific examples of such salts are listed hereinabove in Tables 1 and 2. Preferably, the salts are located in, and obtained via aqueous mining from, an aqueous source that is co-located with the dissociating reactor. Co-location of the aqueous source and dissociating reactor minimizes the energy expenditure and environmental impact of aqueous mining, as will be appreciated by those having ordinary skill in the art upon reading the present disclosure. Even more preferred are implementations in which the dissociating reactor is co-located with the aqueous source, and a renewable energy power plant. According to particularly preferred embodiments, the aqueous source is a renewable energy source (such as a source of geothermal energy), and the renewable energy power plant derives or is otherwise powered by the renewable energy aqueous source.

Operation 404 of method 400 involves dissociating, using the dissociating reactor, the at least one salt into a plurality of dissociated species, wherein the dissociated species comprise at least one refined critical mineral. As referenced herein, critical minerals may include any type of ionic conductor, preferably metals such as elemental lithium, elemental sodium, elemental magnesium, elemental calcium, elemental copper, etc. However, it shall be understood that "critical minerals" are not limited to metals—in some approaches the "critical mineral" refined in the dissociating reactor is or includes elemental carbon. In preferred approaches, the dissociation (e.g., including generation of a non-equilibrium plasma) is driven by energy provided by the co-located renewable energy power plant.

In preferred approaches, the dissociation of species from input materials involves generating a non-equilibrium plasma, such as a pulsed microwave plasma, within the dissociating reactor. As described in greater detail hereinabove, energies achieved within the dissociating reactor are sufficient to "crack" the input materials, resulting in a plurality of elemental ionized and neutral species that can be collected, and such collection may be facilitated by tuning the conditions in the reactor so as to prevent reformation or precipitation of the dissociated species back into original form, or into different compounds other than the desired refined critical mineral. Details regarding exemplary tuning parameters are set forth hereinabove and in the various Patent Applications incorporated herein by reference, and the tuning of the plasma as described herein may employ any such parameters, techniques, etc. in any combination without departing from the scope of the inventive concepts presented herein.

According to operation 406 of method 400, and as mentioned above, the at least one refined critical material is collected. Collection of the desired refined critical mineral may be optimized through use of selective getter material(s) such as tungsten, tantalum, iron phosphate, etc. as would be appreciated by skilled artisans upon reading these descriptions. In select implementations, prior to collection, the refined critical material may be passivated, e.g., by monatomic hydrogen present in the dissociating reactor during refinement of the critical mineral(s) or using a separate refinement step. Advantageously, the presently disclosed aqueous mining and dissociative refinement techniques produce refined critical minerals that are characterized by substantial absence of defects, particularly faceted defects, on surface(s) thereof. Faceted defects are a substantial concern in fabrication of energy storage devices, particularly lithium-based and sodium-based secondary batteries.

Turning now to techniques for using the hereinabove described systems and apparatuses for substantially continuous refinement of critical minerals, and particularly critical minerals present in input materials obtained via aqueous mining techniques, FIG. 5 depicts a flowchart of one such suitable method 500, according to one implementation. It shall be understood that method 500 may be performed in any suitable environment and/or using any suitable apparatus, including but not limited to those shown in FIGS. 1-3D and corresponding descriptions thereof. Moreover, unless expressly stated otherwise, method 500 may be performed in combination with one or more operations of other method(s) set forth herein, including but not limited to method 400 as shown in FIG. 4 and described in greater detail above.

Referring again to FIG. 5, in operation 502, method 500 includes receiving, at a dissociating reactor, one or more input materials, wherein the input materials comprise at least one salt including one or more critical mineral components. As described above regarding method 400, the input materials preferably comprise salt(s), e.g., salts where the critical mineral component is the metal component, and the non-metal component is selected from halides, oxides, hydroxides, carbonates, etc. The critical mineral component may be lithium, sodium, magnesium, calcium, copper, and/or carbon, etc. as described herein according to various embodiments. Preferably, the input materials are obtained from an aqueous source, more preferably a renewable energy source such as a source of geothermal energy, that is co-located with the dissociating reactor and a renewable energy power plant that can provide energy required to perform operations necessary for refinement.

Operation 504 of method 500 involves refining, using the dissociating reactor, the at least one salt into at least one refined critical mineral, wherein the refining comprises capturing at least some of the at least one refined critical mineral using at least one getter material present in the dissociating reactor during refinement of the at least one refined critical mineral. Again, as described above regarding method 400, the refined critical material preferably includes elemental lithium, elemental sodium, elemental magnesium, elemental calcium, elementals copper, and/or elemental carbon, etc. and even more preferably is characterized by complete or substantial absence of defects, particularly faceted defects, on surface(s) thereof. The getter material(s) may include tungsten, tantalum, iron phosphate, or any other suitable equivalent thereof that would be understood by a person having ordinary skill in the art upon reading the present disclosure. As noted above, refinement is preferably driven by energy produced using a renewable energy power plant.

According to operation 506 of method 500, dissociating reactor is shut down for a scheduled maintenance operation unrelated to the getter material. The scheduled maintenance operation may be any type of maintenance operation required in the absence of the getter material, such as routine cleaning, repair or replacement of damaged components, renewal of consumable materials, etc. as known in the art. Importantly, however, the need for shutting down the reactor has nothing to do with the presence of the getter material according to method 500. Such shutdown would be performed in the same manner and according to the same schedule for reasons entirely unrelated to presence and use of getter material.

With continuing reference to FIG. 5, operation 508 of method 500 involves replacing or exchanging the at least one getter material while the scheduled maintenance operation is performed on the dissociating reactor. As noted above, the scheduled maintenance does not relate in any way to use or presence of the getter material. A further advantage of implementing the presently described inventive concepts is that replacing or exchanging the at least one getter material does not add any additional downtime to a regular operating schedule of the dissociating reactor. Further still, where replacing or exchanging the at least one getter material is performed via a getter access mechanism of the dissociating reactor, replacing or exchanging the at least one getter material does not require opening of the dissociating reactor. As described hereinabove with particular reference to FIGS. 3A-3D, the getter access mechanism provides direct access to getter material within the reactor, e.g., using a specialized tool and container configured to access the getter material via the getter access mechanism without opening the reactor.

In operation 510 of method 500, normal operation of the dissociating reactor is resumed. Importantly, the duration of the regularly scheduled maintenance operation is not extended by the replacement and/or exchange of getter material(s) set forth in operation 508. Instead, advantageous aspects of using getter material(s) such as described hereinabove can be leveraged without interrupting the normal operating schedule of the dissociating reactor. That is, performing method 500 as set forth herein neither causes any additional interruption of normal reactor operation, nor reduces the operational period or lifetime of normal reactor operation. In this manner, method 500 facilitates continuous, or substantially continuous, operation of the reactor despite utilization of consumable getter material(s), which conveys additional advantages (such as reduced operating pressure) as described hereinabove in greater detail. One additional aspect of reduced operating pressure that will be appreciated in the particular context of method 500—operating at or near atmospheric pressure is a substantial safety benefit as the risk of explosive decompression upon attempting to access material(s) in the reactor is minimized or eliminated.

Of course, since substantially continuous operation of the reactor is an important benefit but not the ultimate goal of the presently described inventive techniques, method 500 preferably includes collecting the refined critical mineral(s). Again, prior to collection, the refined critical minerals may optionally be separated from gas(es) produced in the reactor during the refinement process (e.g., using a gas-solid separator or any other suitable equivalent thereof in the case of carbon growth and collection) and/or passivated (e.g., by monatomic hydrogen produced in the reactor during the refinement process). Passivation, as will be understood by skilled artisans, beneficially protects the refined critical minerals, e.g., from oxidation upon exposure to ambient atmosphere (or other oxidizing conditions). Skilled artisans will appreciate that many of the exemplary refined minerals described herein are reactive in elemental form (particularly lithium, sodium, and magnesium) and will spontaneously react with oxygen in the air. Passivation of the refined minerals (elements) inhibits or prevents such reactions, preserving the refined minerals in desired form.

Pre-Processing of Saline Solution

Figure 7:
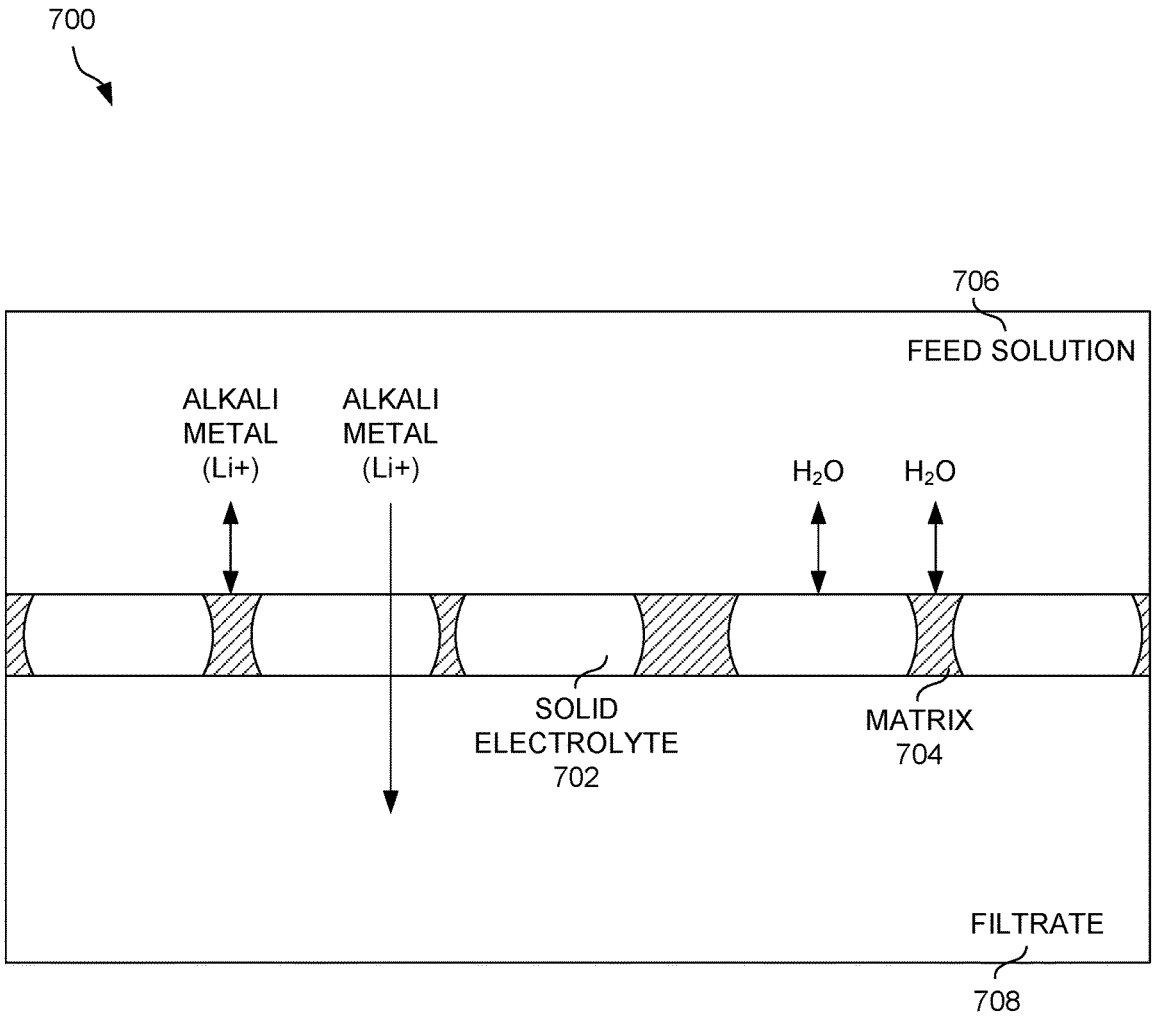
FIG. 7 is a simplified schematic of a pre-processing apparatus comprising a solid electrolyte membrane for extracting species or components of desired critical minerals from a saline solution, according to one embodiment.

FIG. 7 illustrates a solid electrolyte membrane 700, in accordance with one embodiment. As an option, the solid electrolyte membrane 700 may be implemented in the context of any one or more of the embodiments set forth in any previous and/or subsequent figure(s) and/or description thereof. For instance, solid electrolyte membrane 700 may be utilized to separate various species, salts, and/or ions of critical minerals present in a saline solution from one another, and produce a solid (e.g., slurry or powder) form of precursor materials for injection into a DISSOCIATING REACTOR as shown and described hereinabove with regard to FIG. 1. Of course, however, the solid electrolyte membrane 700 may be implemented in the context of any desired environment. Further, the aforementioned definitions may equally apply to the description below.

In the context of the present description, the solid electrolyte membrane 700 may be used to enable the passage of Li+(or any preconfigured alkali metal) ions while preventing all other unwanted substances, such as water, from passing through the solid electrolyte, or through a substrate in which the solid electrolyte is embedded. Additionally, the structure of the solid electrolyte membrane 700 is extremely durable, enabling operation for a significant time without structural degradation or decrease in performance.

Of course, it is to be appreciated that the solid electrolyte membrane 700 could be configured to allow passage of any specific ion. Further, the solid electrolyte membrane 700 may be configured for a high selectivity ratio of ions (such as Na+/Li+, Na+/K+, etc.).

The solid electrolyte membrane 700 improves and solves problems previously associated with prior selective membrane. For example, when using the solid electrolyte membrane 700 as an ion-selective membrane for electrochemical lithium extraction/recycling, it may prevent the electrode from contacting water (which may adversely react with it). Further, the ion-selective membrane may prevent the electrode active material from needing to be directly soaked in the feed solution, which would cause the electrode to dry out, which in turn may lead to cracking when removed from the solution while making the electrode material vulnerable to the contents of the feed solution. Additionally, the ion-selective membrane may resist cracking when taken out of the feed solution due to the fact that the ion-selective membrane may be held together by a densely crosslinked matrix, which may prevent a reconfiguration of the polymer structure (which may occur when a liquid with high surface tension, such as water, is removed from the ion-selective membrane, etc.).

Further, the solid electrolyte membrane 700 may be used as a polysulfide barrier, which may attenuate or remove (even near completely) the polysulfide shuttle phenomena in Li—S batteries. Still yet, the solid electrolyte membrane 700 may protect Li metal (or any alkali metal) from air, enabling the use of Li-air batteries, which have the highest specific energy of any known chemistry for lithium-ion batteries. As such, the solid electrolyte membrane 700 may be used as a conductive barrier to air.

As shown, a solid electrolyte 702 is embedded in a matrix 704. In one embodiment, the solid electrolyte 702 may be embedded in aluminized mylar. The combination of the solid electrolyte 702 and the matrix 704 represents a membrane. In one embodiment, as illustrated, feed solution 706 may include an alkali metal (such as Lit) and a liquid (such as water, $H_2O$). The membrane may be water impermeable such that the water may be prevented from crossing the solid electrolyte 702 and the matrix 704. In contrast, the alkali metal (such as Lit) may not pass thorough the matrix 704 but may pass through the solid electrolyte 702. That which passes through the membrane may be found in the filtrate 708. Additionally, in addition to repelling water, the membrane may also repel polysulfides, air (including but not limited to oxygen, nitrogen, carbon dioxide, etc.), etc.

The membrane may be composed of solid electrolyte particles (shown as the solid electrolyte 702) within a dense matrix (shown as the matrix 704). Each individual solid electrolyte particle may completely traverse the membrane such that a Li+ ion (or any alkali metal ion) entering from one side of the membrane enters the membrane through the same solid electrolyte particle that it exits the membrane from (i.e., it does not need to pass through any solid-solid interface). In one embodiment, completely traversing the membrane as a single particle may allow for higher conductivity, as the transport pathway may be more direct (especially compared to Li+ transport pathways that go through many solid-solid interfaces which may in turn have lower Li+ conductivity).

In one embodiment, the solid electrolyte membrane 702 may also prevent water from passing through the space in between the solid electrolyte particles and the matrix 704. In one embodiment, this may be due to the fact that the matrix 704 may interact strongly with the solid electrolyte particles of the solid electrolyte 702. Additionally, the solid electrolyte particles of the solid electrolyte 702 may be functionalized to improve interactions with the matrix 704. For example, in one embodiment, if using the solid electrolyte LATP, which is rich in phosphates, acrylic acid derivatives (such as 2-(aminoethyl)methacrylate) may be used to react with the surface phosphates (via Michael addition) in order to enrich the surface of the solid electrolyte 702 with amine groups. As such, the epoxide molecules from the matrix 704 may covalently bond with the solid electrolyte particles of the solid electrolyte 702.

Although the alkali metal is shown as Li+ in the solid electrolyte membrane 700, it is to be appreciated that any ion of choice can be selected. Depending on the ion that should be separated, the solid electrolyte may be replaced with the appropriate material. For example, in one embodiment, if Na+ separation is desired, then NASICON can be used in place of LiSICON as the solid electrolyte. Of course, it is to be appreciated that any other ions (such as K+, Rb+, Cs+, etc.) may be separated based on accompanying solid electrolyte materials. Further, it is to be appreciated that LiSICON is a member of the NASICON family of solids, which is composed of ZrO6 octahedra and PO4/SiO4 tetrahedra that share common corners, with Na+ in the interstitial space. LiSICON may have a structural analogue with MO6 (M=Ti, Ge, Zr, Hf, Sn) octahedra and PO4 tetrahedra and Li+ in the interstitial sites. Such solid electrolytes may have high resistance to degradation and/or corrosion in water. It is to be appreciated that other materials may likewise work (that provide resistance to degradation and/or corrosion in water).

Additionally, the process can be tuned such that any desired volume fraction of solid electrolyte particles within the matrix can be achieved. For example, a slurry may be cast in which all particles are the same size and are hexagonally close packed such that the volume fraction of particles in the casted membrane is maximized. For example, maximizing the volume fraction may include maximizing the volume for a particular given particle size distribution. In other words, if all the particles are the same exact size, then hexagonally close packing may be the most efficient way to make use of the volume. However, in one embodiment, it may be possible to use an even higher volume fraction of the membrane if particles of multiple sizes and/or of different shapes are used. The volume fraction of solid electrolyte particles may then be further increased by removing an increasingly large amount of membrane (via abrasive polishing) on both sides. In this manner, any volume fraction of solid electrolyte particles can be achieved. Creating a membrane with a higher volume fraction of solid electrolyte may require polishing down the membrane film to thinner membranes, thereby removing higher fractions of the initial membrane.

Further, although the solid electrolyte membrane 700 are shown as having spherical solid electrolyte particles, it is to be appreciated that particles of the solid electrolyte 702 do not necessarily need to be spherical. For example, the particles of the solid electrolyte 702 may be donut shaped, blood-cell shaped, and/or any other specifically desired shape (which may be created based on the tuning the spray drying process, specifically the feed rate of the aqueous precursor, to shape the particles). Additionally, particles of the solid electrolyte 702 can be prepared by preparing a precursor solution and regular drying, followed by sintering, yielding non-spherical particles. Ball milling can then be used to reduce the particle size.

To maximize kinetic flow, it is recommended that an ion traverse a single particle of the solid electrolyte 702. However, the solid electrolyte membrane 700 may include multiple layers of the solid electrolyte 702, which may cause an ion to traverse or hop from one particle of the solid electrolyte 702 to another particle of the solid electrolyte 702. Having multiple layers of the solid electrolyte 702 may allow for more uniform distribution of particles within the matrix.

Additionally, multiple membranes (such as the solid electrolyte membrane 700 and another of the solid electrolyte membrane 700) can be stacked together to make a thicker membrane (which may be used for ion selectivity, kinetic flow, greater filtering capability, etc.). In such an embodiment, the individual layers of more than one membrane each can be joined together with a Li+(or other, preferably alkali, metal ion selected) conductive adhesive, such as a matrix containing polyethylene glycol diglycidyl ether (PEG-DGE) and/or Jeffamine D-230, and a lithium salt, such as lithium bis (trifluoromethanesulfonyl)imide (LiTFSI). Of course, it is to be appreciated that other Li+ conductive adhesives may be used to enable the fabrication of a multilayered membrane.

In one embodiment, rather than using mechanical polishing, laser ablation and/or chemical etching may be used to shave down the surfaces of the solid electrolyte membrane 700 and expose the particles of the solid electrolyte 702 to the surfaces. Additionally, ion milling or focused ion beams (FIB) may be used to polish the surface.

Figure 8:
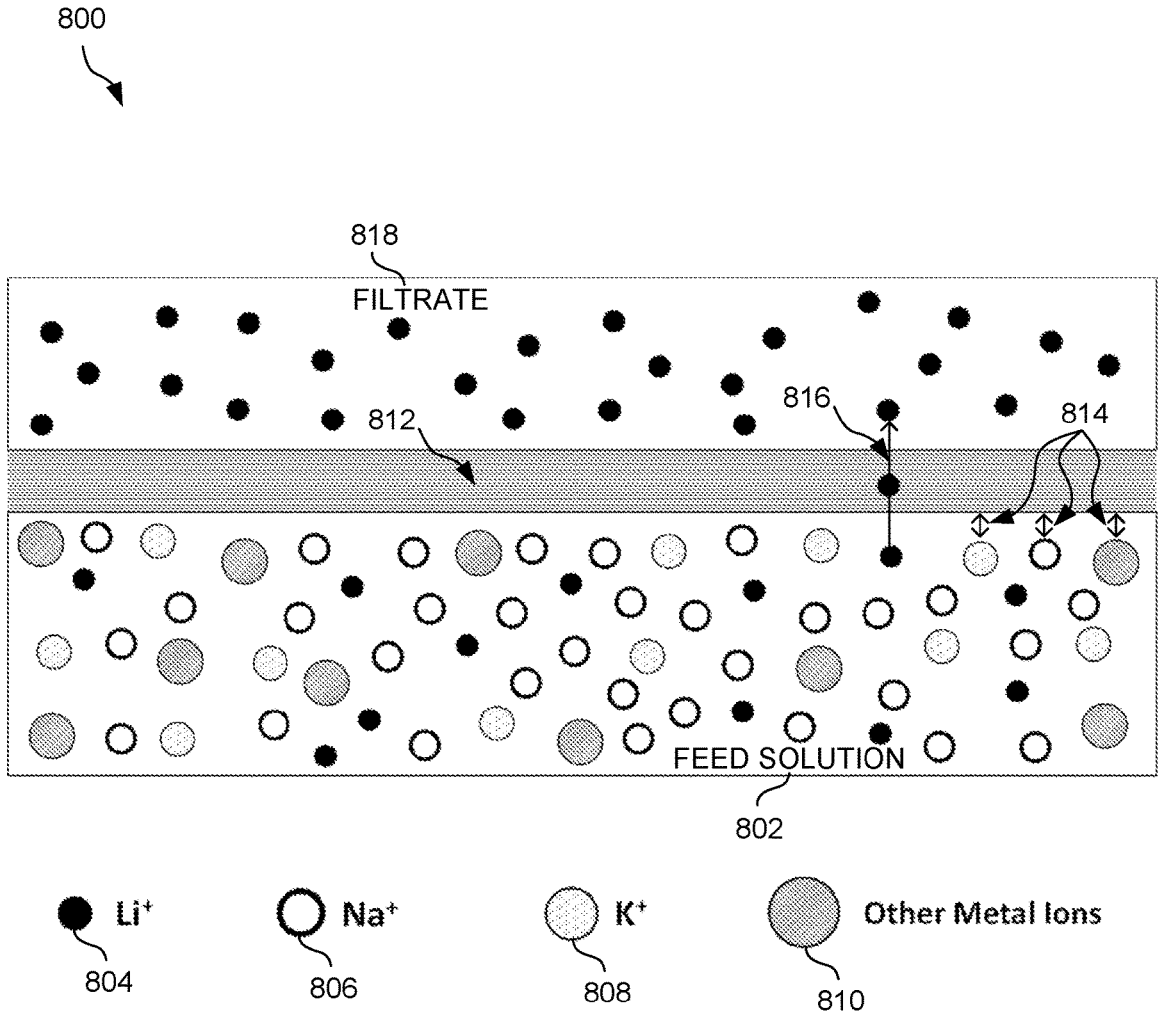
FIG. 8 is a simplified schematic of an ion-selective separation membrane configured to separate ions such as sodium, lithium, and/or potassium present in a saline solution from one another, according to one implementation.

FIG. 8 illustrates an ion-selective solid electrolyte membrane 800, in accordance with one embodiment. As an option, the ion-selective solid electrolyte membrane 800 may be implemented in the context of any one or more of the embodiments set forth in any previous and/or subsequent figure(s) and/or description thereof. For instance, ion-selective solid electrolyte membrane 800 may be utilized to separate various species, salts, and/or ions of critical minerals present in a saline solution from one another, and produce a solid (e.g., slurry or powder) form of precursor materials for injection into a DISSOCIATING REACTOR as shown and described hereinabove with regard to FIG. 1. Of course, however, the ion-selective solid electrolyte membrane 800 may be implemented in the context of any desired environment. Further, the aforementioned definitions may equally apply to the description below.

As shown, the ion-selective solid electrolyte membrane 800 includes a feed solution 802, which may include a collection of many different types of ions, including but not limited to lithium $Li^{+}$804, sodium $Na^{+}$806, potassium $K^{+}$, and/or other metal ions 810. The feed solution 802 may additionally include any aqueous solution containing one or more of lithium $Li^{+}$804, sodium $Na^{+}$806, potassium $K^{+}$, and/or other metal ions 810.

Additionally, a membrane 812 may be used to selectively allow an ion, in this exemplified case, lithium $Li^{+}$804, to pass 816 through the membrane 812. In contrast, the membrane 812 may be used to prevent other ions, in this exemplified case, sodium $Na^{+}$806, potassium $K^{+}$, and/or other metal ions 810, from passing 814 through the membrane 812. The accumulated ions that pass through the membrane 812 may be found in the filtrate 818.

It is to be appreciated that world demands for lithium continues to increase (especially as demands for electrification of vehicles increase). Using the ion-selective solid electrolyte membrane 800 may allow for extraction of lithium from lithium minerals, as well as from otherwise unused or discarded sources, including but not limited to recycled lithium batteries, and even seawater (especially as seawater contains >99% of the Earth's accessible Li supply). Current systems (such as from Li brines and/or Li minerals) fail to recover lithium (and other alkali metals) from unconventional sources, and/or are problematic (in terms of selectivity, durability, and/or scalability).

Figure 9:
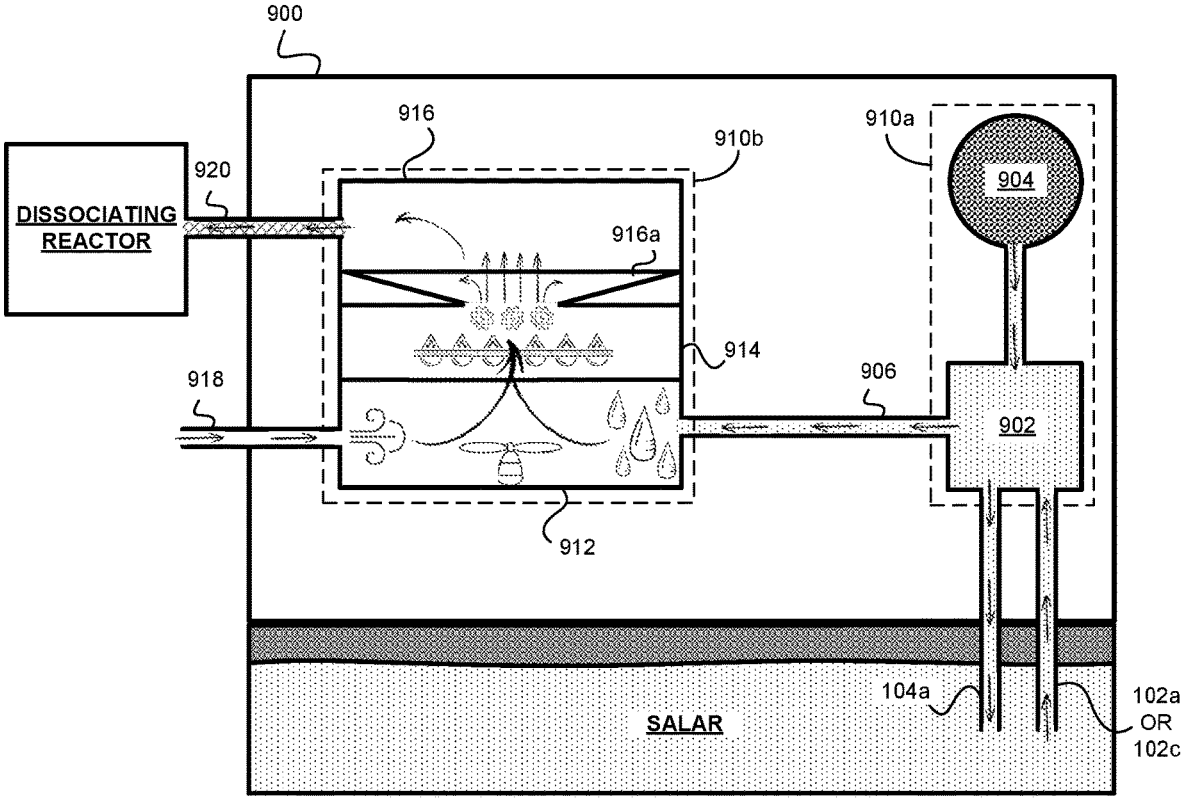
FIG. 9 is a simplified schematic of a PREPROCESSING FACILITY configured to convert input aqueous material into suitable form for input into DISSOCIATING REACTOR and facile dissociation of respective components therein, according to an exemplary embodiment.

Turning now to FIG. 9, a simplified schematic of a PREPROCESSING FACILITY 900 is shown, according to one exemplary implementation. It will be apparent from the present descriptions that the implementation depicted in FIG. 9 may, e.g., be employed in the overall schematic 100 of a brine-fed reactor configuration as shown in FIG. 1 and described hereinabove. Of course, skilled artisans will appreciate upon reading this disclosure that any suitable equivalent or alternative for the PREPROCESSING FACILITY 900, or components thereof, may be modified, substituted, or used in combination with, the features shown in FIG. 9 without departing from the scope of the inventive concepts presented herein. The important aspect of PREPROCESSING FACILITY 900, or any equivalent employed in the context of the inventive concepts presently disclosed, is the ability to convert aqueous (e.g., saline) solutions including component(s) of critical minerals that are obtained from aqueous sources such as a SALAR, etc., from liquid phase to a solid (preferably powderized) form. Optionally but preferably, the PREPROCESSING FACILITY also includes requisite components/functionality to extract or enrich desired critical mineral components obtained from the aqueous source.

To this effect, PREPROCESSING FACILITY 900 as depicted in FIG. 9 includes a reaction stage 910*a* and a separation stage 910*b* (indicated by dashed lines). According to various embodiments, reaction stage 910*a* may include any equipment, components, consumables, etc. as would be understood by one having ordinary skill in the art as suitable for converting saline solution, or at least desired components of critical minerals contained therein, from one chemical form to another, and/or for producing a dried or fluidic product therefrom, such as precipitated salts, a slurry, a suspension, etc. Similarly, separation stage 910*b* may include any equipment, components, consumables, etc. as would be understood by one having ordinary skill in the art as suitable for separating desired components of refined minerals (e.g., salts) from other undesired components (e.g., of the saline solution, whether solid, liquid, or gaseous) to yield an output product comprising a powder containing the desired components of the critical minerals, which may optionally be disposed in a fluidic carrier material, but in any event is suitable for injection into DISSOCIATING REACTOR.

In one exemplary approach, the PREPROCESSING FACILITY 900 includes an inlet such as inlet 102*a* or 102*c* as shown and described hereinabove with respect to FIG. 1. Similarly, the PREPROCESSING FACILITY 900 includes an outlet, such as inlet 104*a* as shown and described hereinabove with respect to FIG. 1. The inlet 102*a*/102*c* is configured to provide saline solution, e.g., from a SALAR (in the case of inlet 102*a*) or a RENEWABLE ENERGY POWER PLANT (in the case of inlet 102*c*) to the reaction stage 910. Reaction stage 910, in turn, includes a reaction chamber 902 and salt source 904. In operation, saline solution is provided to the reaction chamber via the inlet 102*a*/102*c*, wherein conditions are tuned to facilitate conversion of materials, especially salts, containing desired components of a critical mineral into other materials, again especially salts. The "other materials" shall be understood as having a different chemical composition than salts of the critical minerals as found in the saline solution. Moreover, requisite compounds for converting the salt(s) containing desired components of critical minerals from the chemical composition as found in the saline solution into the "other materials" having different chemical composition may be stored in salt source 904 and provided to the reaction chamber 902 according to conditions understood by those having ordinary skill in the art.

For example, according to one approach input saline solution from the SALAR may include lithium chloride, lithium hydroxide, etc. The lithium-containing salts (or other compounds) may be fed into the reaction chamber 902 via the inlet 102*a*/102*c*, and a sodium-containing salt such as sodium carbonate may be provided to the reaction chamber 902 from salt stock 904. The sodium-containing salt (or other suitable compound) may be provided from salt stock 904 in the form of a solid, a saline solution, or any other suitable equivalent that would be appreciated by a person having ordinary skill in the art upon reading the present disclosure.

In preferred embodiments, the saline solution input from the SALAR may be purified, filtered, etc. to isolate desired components, ions, etc. therein for delivery to the reaction chamber 902. For instance, size-exclusion and/or ion-exclusion membrane(s), such as shown and described hereinabove with respect to FIGS. 7 and 8, may be implemented in or with the PREPROCESSING FACILITY 900. Particularly preferred approaches, the input ultimately provided to the reaction stage (e.g., after purification, filtration, etc.) consists essentially, or entirely, of an ion corresponding to a critical mineral desired for refinement in the context of the presently disclosed inventive concepts. As utilized herein, aqueous solution input "consists essentially" of a particular ion corresponding to a critical mineral when the aqueous solution contains the particular ion, but contains no more than a negligible amount of other ions or compounds that may participate in, or otherwise interfere with the intended conversion reaction to be performed in the reaction chamber 902.

According to one example, an aqueous solution input consists essentially of lithium ions if, in the form provided to reaction chamber 902, the aqueous solution contains lithium ions, but does not contain sodium ions in any non-negligible amount for purposes of converting sodium carbonate into lithium carbonate. Similarly, an aqueous solution input consists essentially of lithium ions if, in the form provided to reaction chamber 902, the aqueous solution contains lithium ions, but does not contain chloride ions or carbonate ions in any non-negligible amount for purposes of converting sodium carbonate into lithium carbonate. Skilled artisans will appreciate other suitable forms of aqueous solutions that "consist essentially" of a given ion or compound in the context of other exemplary materials described herein, including but not limited to compounds containing desired critical minerals (or their precursors, analogs, etc.) such as carbon, lithium, sodium, magnesium, calcium, etc.

As a specific example, input provided to the reaction stage 902 according to an illustrative implementation consists essentially or entirely of lithium ions in aqueous solution. Those having ordinary skill in the art will appreciate that purifying, filtering, etc. input prior to delivery to reaction stage 902 advantageously improves the overall efficiency of converting the desired components of critical minerals found in the SALAR into refined critical minerals. For example, providing only ionic components of the desired critical mineral(s) may imbalance the conversion process in favor of desired intermediates, e.g., lithium carbonate according to the example presently described.

Conditions within the reaction chamber (e.g., pressure, temperature, pH, salt concentration, atmospheric composition, mixing, flow control, agitation, etc.) are created and maintained so as to facilitate substitution of desired components (here, sodium) in the compound(s) provided from salt stock 904 with desired components (here, lithium) in the compound(s) provided from the SALAR. For instance, according to the present example, lithium may substitute sodium in the sodium carbonate, yielding lithium carbonate and a corresponding sodium-containing salt (e.g., sodium chloride, sodium hydroxide, etc. according to various embodiments and as would be understood by skilled artisans upon reading the instant descriptions). Preferably, the compound(s) including the desired critical mineral component(s) (here, the lithium carbonate) are collected, e.g., in the form of solid precipitate, and may optionally be combined with a fluidic carrier or other suitable medium. In similar manner, the resulting "waste" compound(s) (such as sodium-based salts in this example), and/or any other undesired components of the saline solution present in the reaction chamber 902 after completing conversion, may be returned to the SALAR, e.g., via outlet 104*a*.

Upon converting the desired compounds in saline solution obtained from the SALAR in the reaction chamber 902, said compounds (again, preferably in the form of solid salts or solids dispersed in a slurry or suspension) are provided to the drying chamber 912 of separation stage 910*b* via reaction chamber outlet 906.

Whether in liquid, slurry, suspension, or solid form, the materials provided to the drying chamber are dried, e.g., via simple mixing and/or heating, with air provided to the drying chamber 912 via air inlet 918. Of course, in various embodiments, specific gases (such as inert gases, oxidizing gases, etc.) other than or in addition to air may be provided to the drying chamber 912 via air inlet 918. For example, lithium and sodium are highly reactive (particularly in elemental form) under oxidizing atmosphere such as ambient air. Accordingly, drying chamber 912 may be provided inert gas(es) such as nitrogen, argon, xenon, etc. (or other suitably "inert" gas with respect to the desired component(s) of critical minerals being preprocessed) without departing from the scope of the inventive concepts presented herein.

Upon drying, the salts containing desired components of critical minerals for refinement are carried into a griding chamber 914 of separation stage 910*b*, e.g., via currents created within the drying chamber 912 (as indicated by the large arrows in FIG. 9). Grinding chamber 914 includes any suitable mechanism, such as an atomizer, nebulizer, ultrasonic agitation device, etc. as would be understood by a person having ordinary skill in the art upon reading the present disclosure, for rendering the materials input into the grinding chamber 914 into a powderized form, e.g., a powder characterized by particles having a principal dimension with a length in a range from 10 nm to about 100 microns, in various embodiments. Of course, skilled artisans will appreciate that powder having particles with principal dimension greater than the above range may be further processed, e.g., via ball milling or other equivalent approach, to reduce the principal dimension of the particles to be within the desired range from about 10 nm to about 100 microns.

Once ground or otherwise rendered into powdered form, and again as may be driven by air currents within the separation stage 910*b*, the powderized material is directed into a separation chamber 916 including any suitable mechanism for separating various components within the separation chamber from the powderized critical mineral-containing material. For example, according to one embodiment separator mechanism 916*a* may include a gas-solid separator (GSS). Regardless of the particular mechanism for separation, which may include any such known mechanism in the art, powderized output including components of the desired critical minerals to be refined in DISSOCIATING REACTOR are collected via output 920, and provided to said DISSOCIATING REACTOR. As described elsewhere herein, the powderized output may be treated prior to injection into the DISSOCIATING REACTOR, e.g., via combination with a fluidic medium to facilitate the injection process.

Although the foregoing paragraphs and corresponding figures reference refinement of lithium-containing compounds, there are many other (i.e., non-lithium-containing) compounds that can be refined in the disclosed temperature-controlled zone-segregated reactor 200. For example, materials for a lithium-sulfur battery can be produced by control of intra- and extra-reactor process variables. Strictly for illustration and not in any way limiting of the foregoing, battery materials might begin an evolutionary path as carbon particles that are formed in a plasma region of a reactor. Then, upon input of vapor (such as sulfur) into a temperature-controlled flow, the vapor and the particles interact to diffuse the sulfur into the pores of the carbon particles. The carbon particles move through a further temperature-controlled flow into a collector/separator, which in turn conveys the solid materials downstream for post-processing.

In the foregoing specification, the disclosure has been described with reference to specific implementations thereof. It will however be evident that various modifications and changes may be made thereto without departing from the broader spirit and scope of the disclosure. For example, the above-described process flows are described with reference to a particular ordering of process actions. However, the ordering of many of the described process actions may be changed without affecting the scope or operation of the disclosure. Similarly, additional features or operations disclosed in connection with the described processes may be employed in any suitable combination, permutation, etc. unless expressly stated otherwise in this disclosure. In like manner, the various devices, apparatuses, components, functions, and features thereof may be combined and/or employed in any suitable combination, permutation, etc. unless expressly stated otherwise in this disclosure. The specification and drawings are to be regarded in an illustrative sense rather than in a restrictive sense.

What is claimed is:

1. A method for refining one or more critical minerals, using a dissociating reactor, the method comprising:

receiving, at the dissociating reactor, one or more input materials, wherein the one or more input materials comprise at least one salt including one or more critical mineral components;

dissociating, using the dissociating reactor, the at least one salt into a plurality of dissociated species, wherein dissociating the input materials into the plurality of dissociated species is driven at least in part by plasma energy generated by the dissociating reactor, and wherein the dissociated species comprise at least one refined critical mineral; and collecting the at least one refined critical mineral.

2. The method as recited in claim 1, further comprising separating the at least one refined critical mineral from one or more gases produced in the dissociating reactor during refinement of the at least one refined critical mineral.

3. The method as recited in claim 1, wherein the one or more critical mineral components are metal components of the at least one salt.

4. The method as recited in claim 1, wherein the at least one salt comprises halides, hydroxides, oxides, and/or carbonates of the at least one refined critical mineral.

5. The method as recited in claim 1, wherein the at least one refined critical mineral is selected from the group consisting of: elemental lithium, elemental sodium, elemental calcium, elemental magnesium, elemental copper, elemental carbon, and combinations thereof.

6. The method as recited in claim 1, wherein the dissociating is driven by energy generated using a renewable energy source and/or a renewable energy power plant.

7. The method as recited in claim 6, wherein the renewable energy source comprises a geothermal energy source, and/or wherein the renewable energy power plant comprises a geothermal power plant.

8. The method as recited in claim 7, wherein the geothermal power plant is powered by an aqueous source from which the input materials are obtained via aqueous mining, and wherein the aqueous source is co-located with the geothermal power plant.

9. The method as recited in claim 1, wherein the input materials are obtained via aqueous mining from an aqueous source co-located with the dissociating reactor.

10. The method as recited in claim 1, wherein collecting the at least one refined critical mineral comprises capturing the at least one refined critical mineral using at least one selective getter material.

11. The method as recited in claim 10, wherein the at least one selective getter material is selected from the group consisting of: tantalum, tungsten, iron phosphate, silicon, activated carbon, nickel monoxide, zeolites, metal foams, and combinations thereof.

12. The method as recited in claim 1, further comprising passivating at least some of the at least one refined critical mineral produced in the dissociating reactor either during refinement of the at least one refined critical mineral, or after refinement of the at least one refined critical mineral.

13. The method as recited in claim 1, wherein the collected at least one refined critical mineral is characterized by an absence of faceted defects on one or more surfaces thereof.

14. The method as recited in claim 1, wherein dissociating the input materials into the plurality of dissociated species is driven at least in part by pulsed microwave energy generated by the dissociating reactor.

15. A method for substantially continuous refinement of one or more critical minerals using a dissociating reactor, the method comprising:

receiving, at the dissociating reactor, one or more input materials, wherein the input materials comprise at least one salt including one or more critical mineral components;

refining, using the dissociating reactor, the at least one salt into at least one refined critical mineral, wherein refining the at least one salt into the at least one refined critical mineral is driven at least in part by plasma energy generated by the dissociating reactor, and wherein the refining comprises capturing at least some of the at least one refined critical mineral using at least one getter material present in the dissociating reactor during refinement of the at least one refined critical mineral;

shutting down the dissociating reactor for a scheduled maintenance operation unrelated to the getter material;

replacing or exchanging the at least one getter material while the scheduled maintenance operation is performed on the dissociating reactor; and resuming normal operation of the dissociating reactor.

16. The method as recited in claim 15, wherein replacing or exchanging the at least one getter material does not add any additional downtime to a regular operating schedule of the dissociating reactor.

17. The method as recited in claim 15, wherein replacing or exchanging the at least one getter material does not require opening of the dissociating reactor.

18. The method as recited in claim 15, wherein replacing or exchanging the at least one getter material is performed via a getter access mechanism of the dissociating reactor.

19. The method as recited in claim 15, further comprising collecting the at least one refined critical mineral.

20. A method for refining one or more critical minerals, using a dissociating reactor, the method comprising:

receiving, at the dissociating reactor, one or more input materials, wherein the one or more input materials comprise at least one salt including one or more critical mineral components;

dissociating, using the dissociating reactor, the at least one salt into a plurality of dissociated species, wherein dissociating the input materials into the plurality of dissociated species is driven at least in part by pulsed microwave energy generated by the dissociating reactor, and wherein the dissociated species comprise at least one refined critical mineral; and collecting the at least one refined critical mineral.

* * * * *